US010876508B2

(12) United States Patent
Matsuzawa et al.

(10) Patent No.: US 10,876,508 B2
(45) Date of Patent: Dec. 29, 2020

(54) FUEL INJECTION VALVE

(71) Applicant: Hitachi Automotive Systems, Ltd., Hitachinaka (JP)

(72) Inventors: Mitsuhiro Matsuzawa, Tokyo (JP); Kazuki Yoshimura, Tokyo (JP); Eiji Ishii, Tokyo (JP); Akihiro Yamazaki, Hitachinaka (JP); Takahiro Saito, Hitachinaka (JP); Nobuaki Kobayashi, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 88 days.

(21) Appl. No.: 16/343,902

(22) PCT Filed: Sep. 1, 2017

(86) PCT No.: PCT/JP2017/031614
§ 371 (c)(1),
(2) Date: Apr. 22, 2019

(87) PCT Pub. No.: WO2018/116534
PCT Pub. Date: Jun. 28, 2018

(65) Prior Publication Data

US 2020/0182212 A1 Jun. 11, 2020

(30) Foreign Application Priority Data

Dec. 19, 2016 (JP) ..... 2016-245131

(51) Int. Cl.
*F02M 61/18* (2006.01)
*F02M 63/00* (2006.01)

(52) U.S. Cl.
CPC .... *F02M 61/1853* (2013.01); *F02M 61/1806* (2013.01); *F02M 63/0031* (2013.01); *F02M 63/0077* (2013.01)

(58) Field of Classification Search
CPC ..... F02M 61/162; F02M 61/1806; F02M 61/1813; F02M 61/182; F02M 61/184;
(Continued)

(56) References Cited

U.S. PATENT DOCUMENTS 6,848,636 B2 * 2/2005 Munezane ..... F02M 51/0678 239/533.12
7,059,547 B2 * 6/2006 Kobayashi ..... B05B 1/14 239/533.12
(Continued)

FOREIGN PATENT DOCUMENTS

JP 2002-115627 4/2002
JP 2003-336562 A 11/2003
(Continued)

OTHER PUBLICATIONS

International Search Report (PCT/ISA/210) issued in PCT Application No. PCT/JP2017/031614 dated Oct. 3, 2017 with English translation (four (4) pages).
(Continued)

*Primary Examiner* — Darren W Gorman
(74) *Attorney, Agent, or Firm* — Crowell & Moring LLP

(57) ABSTRACT

Provided is a fuel injection valve which can be easily processed and can realize sufficient atomization while suppressing spreading of spray. In the fuel injection valve according to the present invention, when a nozzle plate 6 and a first direction 15*a*-1 in which fuel is sprayed are projected onto a virtual plane perpendicular to a central axis line of the fuel injection valve along an opening and closing valve direction of a valve body and a first orthogonal coordinate system having an X1 passing through a center O1 of the nozzle plate 6 and along the first direction 15*a*-1 and a Y1 axis passing through the center O1 of the nozzle plate 6 and perpendicular to the X1 axis is virtualized on the virtual plane, an introduction passage 11*a*-1 is inclined so that a
(Continued)

straight line segment 14*a*-1 connecting between a central point 40*a*-1 of an upstream side end portion and a center Oa-1 of an inlet opening surface of a fuel injection hole 13*a*-1 is positioned on the Y1 axis side with respect to a straight line 30*a*-1 passing through the central point 40*a*-1 and the center O1 of the nozzle plate 6.

6 Claims, 14 Drawing Sheets

(58) Field of Classification Search
CPC ..... F02M 61/1846; F02M 61/1853; F02M 61/188; F02M 63/0031; F02M 63/0077
USPC ..... 239/533.12
See application file for complete search history.

(56) References Cited

U.S. PATENT DOCUMENTS 8,567,701 B2 * 10/2013 Hashii ..... F02M 61/1853 239/601
2003/0234005 A1 12/2003 Sumisha et al.
2014/0021274 A1 1/2014 Hashii et al.
2015/0233333 A1 * 8/2015 Hashii ..... F02M 51/0682 239/562
2015/0337785 A1 * 11/2015 Kawasaki ..... F02M 61/04 137/599.01

FOREIGN PATENT DOCUMENTS

JP 2008-064094 3/2008
JP 2010-265865 A 11/2010
JP 2015-81557 4/2015
JP 2016-70070 A 5/2016
JP 2016-070243 5/2016

OTHER PUBLICATIONS

Japanese-language Written Opinion (PCT/ISA/237) issued in PCT Application No. PCT/JP2017/031614 dated Oct. 3, 2017 (four (4) pages).

* cited by examiner

FUEL INJECTION VALVE

TECHNICAL FIELD

The present invention relates to a fuel injection valve used in an internal combustion engine such as a gasoline engine, in which a valve body comes into contact with a valve seat to prevent fuel from leaking and the valve body is separated from the valve seat to perform injection.

BACKGROUND ART

In recent years, exhaust gas regulation of automobiles has been tightened. To cope with the tightening of the exhaust gas regulation, atomization and accurate injection direction are required for spray of a fuel injection valve mounted on an automotive internal combustion engine. It is possible to achieve a low fuel consumption of the automobile engine by the atomization of the spray. In addition, by injecting the spray to a target position, it is possible to suppress the spray from adhering to a wall surface of an intake pipe or the like. A mode in which the spray is injected toward the intake valve as the target position has been mainly used. In addition, a mode in which two intake valves are mounted on one cylinder is mainly used. In this case, the spray injected from the fuel injection valve is constituted by two sprays (two-way spray) which direct two intake valves.

For example, JP 2003-336562 A (PTL 1) discloses a fuel injection valve capable of effectively promoting atomization of fuel after injection. In the fuel injection valve of PTL 1 in which a lateral passage communicating with a downstream side of a valve seat and a swirling chamber in which a downstream end of the lateral passage is opened in a tangential direction are provided between a valve seat member and an injector plate joined to a front end surface of the valve seat member, and fuel injection holes (hereinafter, referred to as a spray hole) through which fuel swirled in the swirling chamber is injected are punched on the injector plate, the spray holes are disposed offset by a predetermined distance from the center of the swirling chamber toward an upstream end side of the lateral passage (see abstract).

In addition, for example, JP 2010-265865 A (PTL 2) discloses a fuel injection valve improving atomization of a fuel spray while suppressing an increase in manufacturing cost, deterioration in flow rate accuracy, and a change in characteristics due to a change in the atmospheric pressure. The fuel injection valve disclosed in PTL 2 has a structure in which a spray hole plate is disposed so that an extension of a seat surface of the valve seat which is reduced in diameter toward the downstream side and an upstream side plane of a spray hole plate intersect each other to form a virtual circle, a plurality of fuel chambers in which a spray hole inlet is opened by recessing a part of the upstream side plane of the spray hole plate at a plurality of positions are formed, and the fuel chamber is disposed at a place which ranges from an inside of the virtual circle to an outside from an inner diameter of a valve seat opening portion (see abstract). In addition, PTL 2 discloses a fuel injection valve in which the fuel chamber has an elliptical shape, a long axis thereof is inclined by $\alpha°$ with respect to a line radially extending from the center of the spray hole plate, and a wall surface inside the virtual circle of the fuel chamber and a wall surface outside from an inner diameter of a valve seat opening portion are both inclined with respect to a line radially extending from the center of the spray hole plate (see paragraph 0044).

In addition, JP 2016-70070 A (PTL 3) discloses a fuel injection valve capable of generating a swirling flow sufficient for atomization of fuel spray while suppressing an increase in a dead volume and an increase of a welding diameter of the spray hole plate. In the fuel injection valve disclosed in PTL 3, two fuel chambers adjacent to each other among a plurality of fuel chambers which are elongated holes in which a part of the upstream side surface (valve seat opposing face) of the spray hole plate is recessed are configured in pairs (see paragraph 0042). The spray hole plate is disposed so as to form the virtual circle where the virtual extension surface of the valve seat surface and the upstream side surface of the spray hole plate intersect each other (see paragraph 0037). A long axis of the fuel chamber is provided at a position rotated by a desired angle set at the time of design toward the paired fuel chamber side based on the intersection point in comparison with a radial straight line connecting between the intersection point (reference point) intersecting with the virtual circle and the center of the valve seat. That is, the end portion on the outside from the virtual circle of the long axis of the fuel chamber is inclined with respect to the radial straight line so as to be closer to the paired fuel chambers along the circumferential direction of the fuel injection valve, based on the intersection point with respect to the radial direction of the virtual circle (see paragraph 0043).

CITATION LIST

Patent Literature

PTL 1: JP 2003-336562 A
PTL 2: JP 2010-265865 A
PTL 3: JP 2016-70070 A

SUMMARY OF INVENTION

Technical Problem

In PTL 1, in order to promote the atomization of fuel, it is considered to increase a swirling force of fuel by increasing a swirl speed of fuel. On the other hand, the whole of an inlet opening surface of a spray hole is out of an extension region of a swirling chamber introduction passage, and the center of the spray hole and a central line of the swirling chamber introduction passage are largely separated from each other. For this reason, the fuel injection valve of PTL 1 has a configuration in which a large swirling force is applied to fuel flowing in the swirling chamber. In this case, the fuel injected from the spray hole has the effect of promoting atomization by a strong swirling force, but on the other hand, there is a problem that the spray widely spreads just under the spray hole by a strong swirling force. If the spray widely spreads just under the spray hole, when a plurality of spray holes are formed in one nozzle plate, the sprays injected from each spray hole overlap each other, and it is difficult to form a spray from one nozzle plate to a plurality of directions. In addition, there is a problem in that the swirling chamber introduction passage and the swirling chamber shape of the fuel injection valve disclosed in PTL 1 are complicated and processing becomes difficult.

In addition, PTL 2 discloses the fuel injection valve capable of improving atomization of fuel spray while suppressing an increase in manufacturing cost, deterioration in flow rate accuracy, and a change in characteristics due to a change in the atmospheric pressure. However, in the fuel injection valve disclosed in PTL 2, in order to improve the atomization of the fuel spray, it is considered to increase an injected hollow liquid film by a centrifugal force by strengthening the swirling flow, and it is not sufficiently considered to promote the atomization of fuel while suppressing the spreading of spray. In addition, in the fuel injection valve of PTL 2, there is a problem in that a distance from a fuel introduction port to the spray hole is short, and a sufficient rectification effect cannot be obtained. In addition, since each fuel chamber is rotated by a predetermined angle in the same direction with respect to the center of the nozzle plate, there is a problem in that a large variation occurs in the characteristics of the spray injected from each spray hole in the case of forming the two-way spray.

In addition, in the fuel injection valve disclosed in PTL 3, it is considered to suppress the increase in the dead volume and to generate the sufficient swirling flow to promote the atomization. However, in the fuel injection valve of PTL 3, it is not considered to suppress the spreading of spray, and is not sufficiently considered to dispose a runaway passage, the swirling chamber, and the spray hole for promoting the atomization of fuel while suppressing the spreading of spray.

Among the above-mentioned problems, the present invention is particularly focused on ease of processing and suppression of spreading of the spray. An object of the present invention is to provide a fuel injection valve which can be easily processed and can realize sufficient atomization while suppressing spreading of spray.

Solution to Problem

To achieve the above object, a fuel injection valve according to the present invention includes:

a valve seat; a valve body which cooperates with the valve seat to open and close a fuel passage by being displaced in an opening and closing valve direction; and a nozzle plate which is provided with a plurality of fuel injection passages constituted by a fuel injection hole and an introduction passage downstream side end portion of which is provided with the fuel injection hole, the plurality of fuel injection passages including a plurality of fuel injection passages through which fuel is sprayed toward a first direction and a plurality of fuel injection passages through which the fuel is sprayed toward a second direction different from the first direction, in which when the nozzle plate and the first direction are projected onto a virtual plane perpendicular to a central axis line of the fuel injection valve along the opening and closing valve direction of the valve body and a first orthogonal coordinate system having an X1 axis passing through a center of the nozzle plate and along the first direction and a Y1 axis passing through the center of the nozzle plate and perpendicular to the X1 axis is virtualized on the virtual plane, in the plurality of fuel injection passages, an inclined fuel injection passages is included so that a straight line segment connecting between a central point of an upstream side end portion of the introduction passage and a center of an inlet opening surface of the fuel injection hole is disposed inclined so as to be positioned on the Y1 axis side with respect to a straight line passing through the central point and the center of the nozzle plate, and the inclined fuel injection passage is disposed in at least one of four partitions divided by the X1 axis and the Y1 axis of the first orthogonal coordinate system.

Advantageous Effects of Invention

According to the present invention, it is possible to realize the sufficient atomization while suppressing the spreading of the spray with the structure easily processed. In addition, problems, configurations and effects other than those described above will be apparent from the description of the following embodiments.

DESCRIPTION OF EMBODIMENTS

Figure 1:
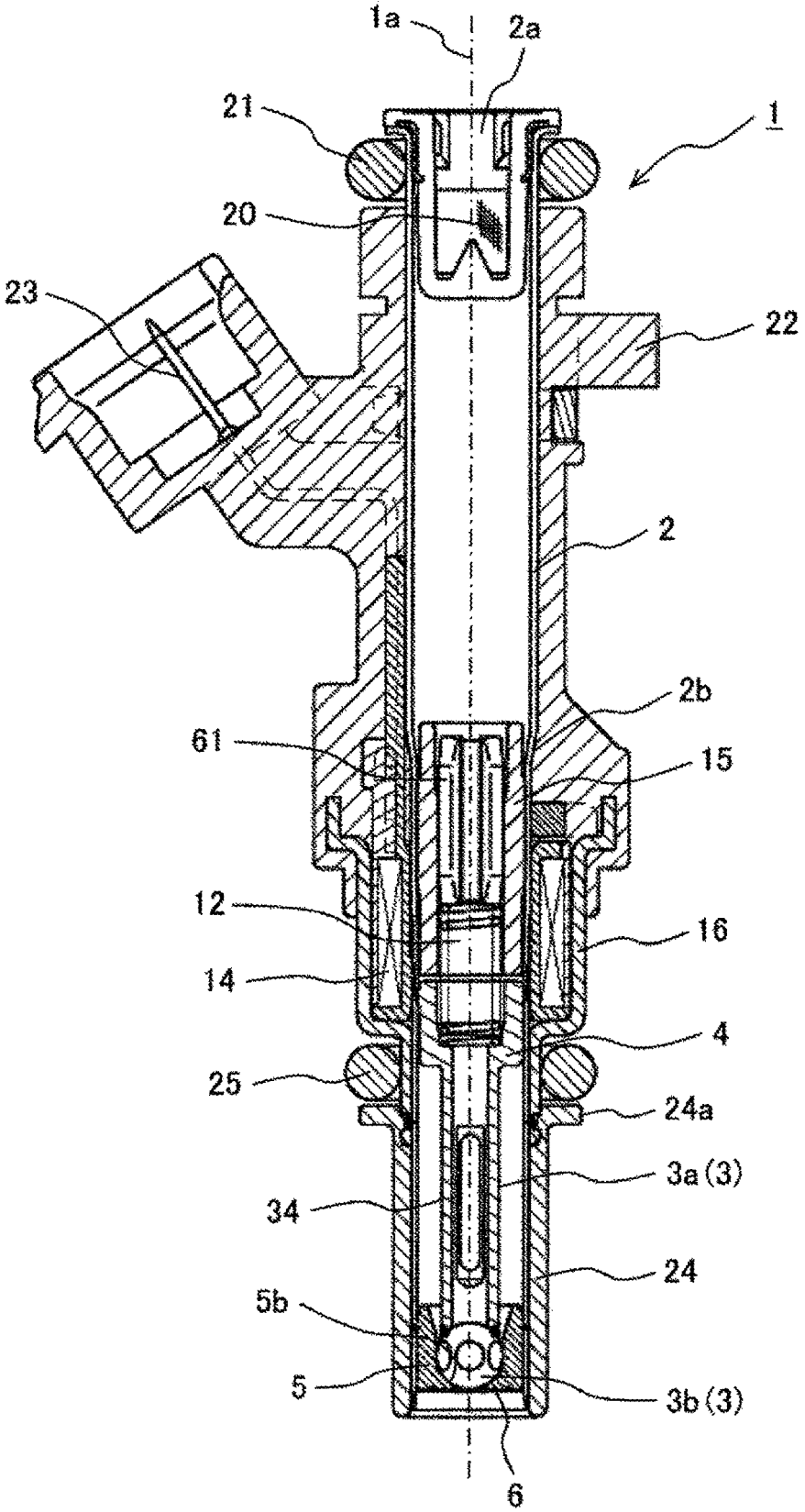
FIG. 1 is a cross-sectional view showing an embodiment of a fuel injection valve 1 according to the present invention.

Hereinafter, embodiments of the present invention will be described with reference to the drawings. In each embodiment, the same reference numerals are assigned to common configurations, and a description thereof is omitted. Further, when describing a vertical relationship in the following description, the vertical direction is defined based on FIG. 1. That is, a base end side on which a fuel supply port 2*a* is provided is defined as an upper side, and a tip side on which a spray hole 13 is provided is defined as a lower side. The vertical direction is not related to a vertical direction in a state in which a fuel injection valve 1 is mounted on an internal combustion engine.

First Embodiment

Hereinafter, a first embodiment of the present invention will be described with reference to FIGS. 1 to 6.

FIG. 1 is a cross-sectional view showing an embodiment of a fuel injection valve 1 according to the present invention. A configuration of the fuel injection valve 1 shown in FIG. 1 is common to second to seventh embodiments described later.

In FIG. 1, the fuel injection valve 1 supplies fuel to an internal combustion engine used as, for example, an automobile engine. A casing 2 has a cylindrical shape having an elongated thin-walled portion by press processing, cut processing, or the like. The casing 2 has a shape in which a stepped portion 2*b* is provided at an intermediate portion of both end portions, and has a cylindrical shape in which a base end portion to a tip portion of the fuel injection valve 1 is substantially integrated. A material is the one in which a flexible material such as titanium is added to a ferrite-based stainless steel material, and is a magnetic material which is magnetized by applying a magnetic field.

A fuel supply port 2*a* is provided on one end surface (upper end face) of the casing 2, and a nozzle plate 6 is provided on the other end surface (lower end face) thereof. The nozzle plate 6 is fixed to a nozzle body 5. The nozzle body 5 is a member in which a valve seat surface 5*b* is formed, and may be referred to as a valve seat surface forming member.

The nozzle plate 6 has a plurality of holes 13 (see FIG. 2) for injecting fuel. The hole 13 is referred to as a spray hole, a fuel injection hole, or the like, but will be hereinafter referred to as the spray hole.

An electromagnetic coil 14 and a yoke 16 of a magnetic material surrounding the electromagnetic coil 14 are provided outside the casing 2 of FIG. 1. On the other hand, a fixed core 15, an anchor 4, a valve body 3, a nozzle body 5, and a nozzle plate 6 are provided inside the casing 2.

The fixed core 15 is inserted into the casing 2, and then is disposed inside the electromagnetic coil 14.

The anchor 4 has a gap between the anchor 4 and a tip side end surface of the fixed core 15 and faces the tip side end face. In addition, the anchor 4 is assembled so as to be displaceable in an axial direction (a direction of a central axis line 1*a*) together with the valve body 3 to be described later. The anchor 4 is manufactured by injection-molding a metal powder consisting of a magnetic material by a method such as metal injection molding (MIM).

The valve body 3 is integrally formed with the anchor 4, and has a hollow rod portion (shaft portion) 3*a* disposed so that an axial center thereof is along an axial direction of the central axis line 1*a* and a ball valve portion 3*b* fixed to a tip portion of the rod portion 3*a*. The valve body 3 may be configured as a separate member from the anchor 4. The valve body 3 and the anchor 4 constitute a mover 34 and are configured to be displaceable in a direction along the central axis line 1*a*. That is, an opening and closing valve direction of the valve body 3 coincides with the direction along the central axis line 1*a*.

The nozzle body 5 is provided on a tip side of the valve body 3 and on the base end side of the nozzle plate 6. The nozzle body 5 is inserted into a tip end portion of the casing 2 and fixed to the casing 2 by welding. In addition, the nozzle body 5 is provided with a valve seat surface 5*b* on which a tip (ball valve portion 3*b*) of the valve body 3 is seated. It should be noted that the "tip side" means a tip portion side (side to which fuel is injected) of the fuel injection valve 1, and the "base end side" means a base end portion side (fuel supply port 2*a* side) of the fuel injection valve 1.

A portion where the valve seat surface 5*b* and the ball valve portion 3*b* abut on each other constitutes a seat portion, and the ball valve portion 3*b* abuts on the valve seat surface 5*b*, thereby closing a fuel passage and the ball valve portion 3*b* is separated from the valve seat surface 5*b*, thereby opening the fuel passage. That is, the valve body 3 and the valve seat surface (valve seat) 5*b* cooperate with each other to open and close the fuel passage of the seat portion. The seat portion of the valve seat surface 5*b* may be referred to as a valve seat. In the present embodiment, there is no particular need to distinguish between the valve seat surface 5*b* and the seat portion, and the valve seat may be either the valve seat surface 5*b* or the seat portion.

The nozzle plate 6 is disposed on a tip side end surface of the nozzle body 5. The nozzle plate 6 is provided with a plurality of spray holes 13 penetrating in a thickness direction. Therefore, the nozzle plate 6 may also be referred to as a spray hole plate or an orifice plate. The spray hole 13 is provided under the valve seat surface 5*b*, and injects fuel, which has passed through the fuel passage of the seat portion, to the outside. The nozzle plate 6 is joined to a surface contacting the nozzle body 5 by welding.

In FIG. 1, a spring 12 as an elastic member is disposed inside a through-hole 15*a* penetrating through a center portion of the fixed core 15. The spring 12 applies a force (biasing force) for pressing the tip (seat portion) of the valve portion 3*b* of the valve body 3 against the seat portion of the valve seat surface 5*b* of the nozzle body 5. A spring adjuster 61 for adjusting the pressing force of the spring 12 is disposed on the fuel supply port 2*a* side (side opposite to the anchor 4) of the spring 12 continuously with the spring 12.

In addition, the fuel supply port 2*a* is provided with a filter 20 to remove foreign matters contained in fuel. In addition, an O ring 21 for sealing fuel to be supplied is attached to an outer periphery of the fuel supply port 2*a*. In addition, a resin cover 22 is provided in the vicinity of the fuel supply port 2*a*. The resin cover 22 is provided so as to cover the casing 2 and the yoke 16 by means of, for example, resin molding or the like. A connector 23 for supplying electric power to the electromagnetic coil 14 is integrally formed on the resin cover 22.

A protector 24 forms a cylindrical member which is provided at the tip portion of the fuel injection valve 1 and is made of, for example, a resin material or the like, and covers an outer peripheral surface of the tip side of the casing 2. An upper end portion of the protector 2 is provided with a plunger portion 24*a* protruding outward in the radial direction from the outer peripheral surface of the casing 2. In addition, the O ring 25 is attached to the outer periphery of the tip side of the casing 2. The O ring 25 is disposed between the yoke 16 and the plunger portion 24*a* of the protector 24 in a detachment-prevention state. When for example, the tip side of the casing 2 (fuel injection valve 1) is attached to an attachment portion (not shown) or the like provided in an intake pipe of an internal combustion engine, the O ring 25 seals between the fuel injection valve 1 and the attachment portion.

When the electromagnetic coil 14 is in a non-conduction state, in the fuel injection valve 1 configured as described above, the tip of the valve body 3 comes into close contact with the nozzle body 5 by the pressing force of the spring 12.

In such a state, since no gap serving as a fuel passage is formed between the valve body 3 and the nozzle body 5, the fuel inflowing from the fuel supply port 2*a* stays inside the casing 2.

When a current as an injection pulse is conducted to the electromagnetic coil 14, a magnetic flux is generated in a magnetic circuit which is constituted by the yoke 16 made of a magnetic material, the fixed core 15, and the anchor 4. The anchor 4 moves until the anchor 4 is in contact with a lower end surface of the fixed core 15 by an electromagnetic force of the electromagnetic coil 14. When the valve body 3 moves to the fixed core 15 side together with the anchor 4, a gap serving as the fuel passage is formed between the valve portion 3*b* of the valve body 3 and the valve seat surface 5*b* of the nozzle body 5. The fuel in the casing 2 inflows from the circumference of the valve portion 3*b* and is then injected from the spray hole 13 (see FIG. 2).

The fuel injection amount is controlled by moving the valve body 3 (the valve portion 3*b*) in an axial direction in response to an injection pulse intermittently applied to the electromagnetic coil 14, thereby adjusting switching timing between an open valve state and a close valve state.

Figure 2:
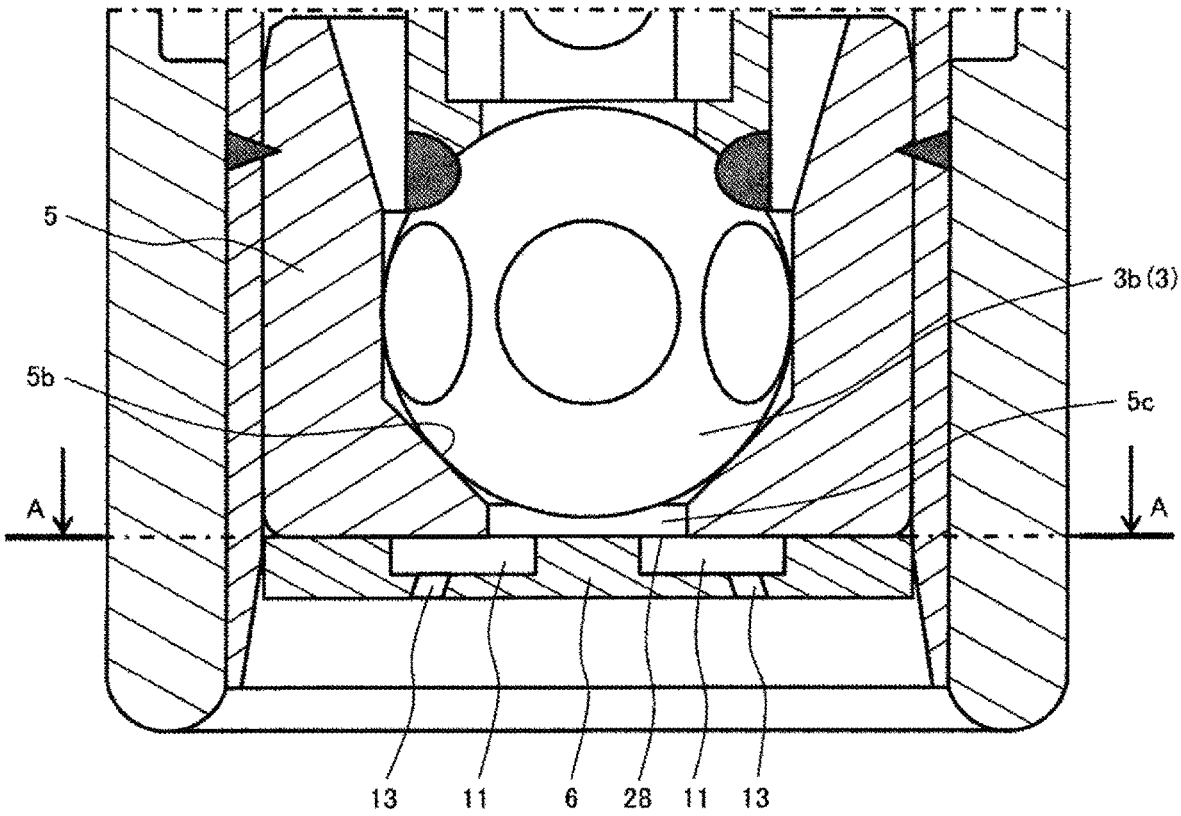
FIG. 2 is an enlarged cross-sectional view of the vicinity of a tip of a valve body 3 of a fuel injection valve 1 according to a first embodiment of the present invention.

FIG. 2 is an enlarged cross-sectional view of the vicinity of the tip of the valve body 3 of the fuel injection valve 1 according to the first embodiment of the present invention. Main components related to the present invention will be briefly described with reference to FIG. 2.

As shown in FIG. 2, the valve portion 3*b* of the valve body 3 uses a ball valve. As the ball 3*b*, for example, a steel ball for ball bearing which is JIS standard product is used. This ball has a high roundness and is subjected to mirror finish, and the ball, which is suitable for enhancing sheet property, can be manufactured at low cost by mass production, and the like should be adopted. In addition, when configured as the valve body, a ball having a diameter of about 3 to 4 mm is used. This is to reduce the weight of the valve body 3 functioning as a movable valve.

In addition, in the nozzle body 5, an inclined surface (valve seat surface 5*b*) including a position of a seat which is in close contact with the valve body 3 becomes a shape of a side surface portion of a truncated cone, and an angle thereof is about 90° (80° to 100°). That is, an angle formed by the valve seat surface 5*b* and the central axis line 1*a* is about 45° (40° to 50°). The angle of the inclined surface is an optimum angle (a grinding machine can be used under best conditions) so as to polish the vicinity of the position of the seat and increase the roundness of the valve seat surface 5*b* in the circumferential direction, and is an angle at which the sheet property with the valve body 3 described above can be kept very high. The hardness of the nozzle body 5 is increased by quenching, and unnecessary magnetism is removed by demagnetization treatment. With such a valve body configuration, it is possible to control the injection amount without fuel leakage. In addition, it is possible to provide the valve body structure with excellent cost performance.

When the fuel injection valve 1 is in a closed state, the valve body 3 abuts on the valve seat surface 5*b* formed of a conical surface to keep fuel seal. At this time, the contact portion on the valve body 3 side is formed of a spherical surface, and the contact between the valve seat surface of the conical surface shape (truncated conical shape) and the spherical surface is substantially in a line contact state.

When the valve body 3 is raised and a gap occurs between the valve body 3 and the nozzle body 5, fuel flows out through the gap, passes through a fuel introduction port 28 from the opening portion 5*c* of the nozzle body 5, flows in each swirling chamber introduction passages 11, and is injected from the spray hole 13 to the outside.

Figure 3:
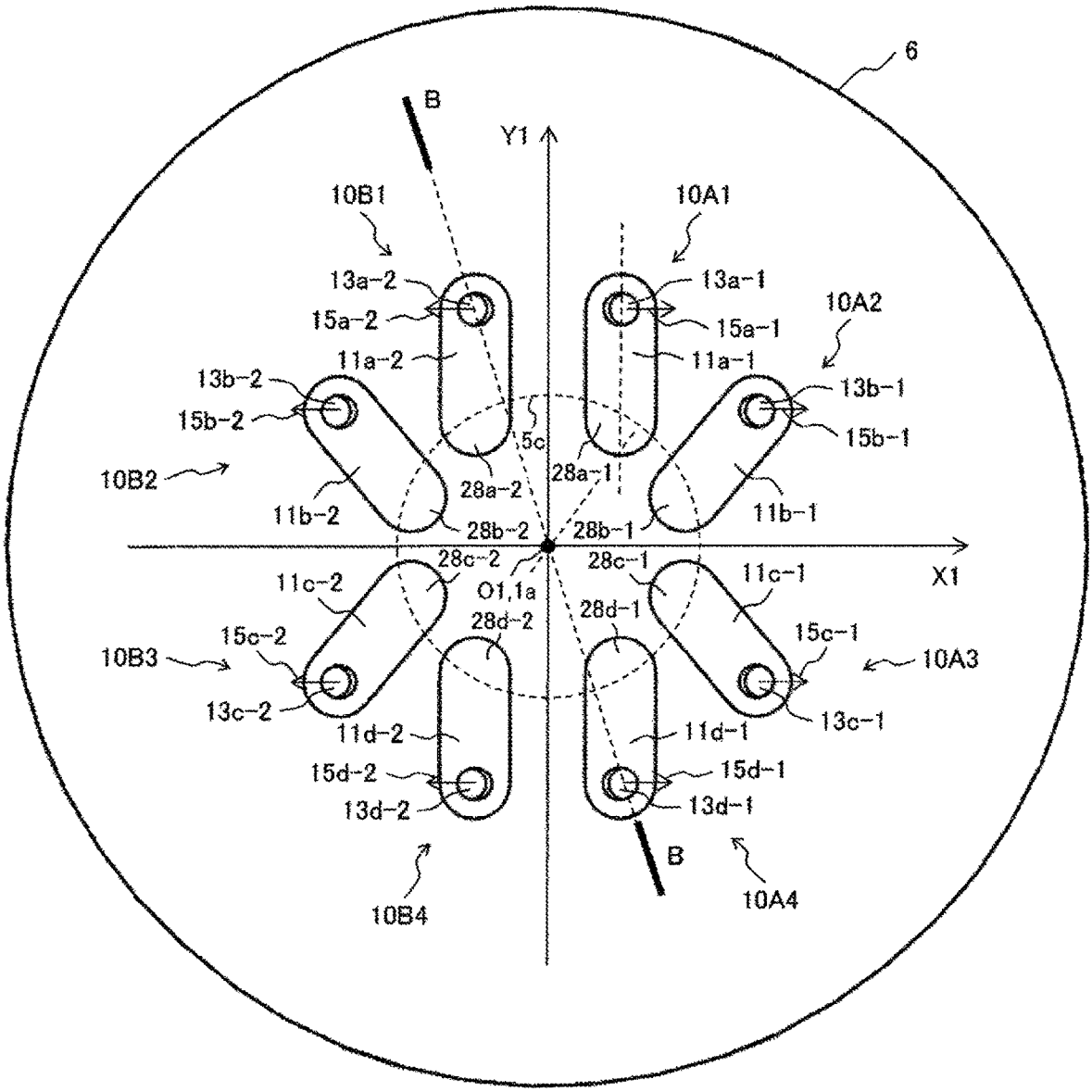
FIG. 3 is a diagram showing a nozzle plate 6 of the fuel injection valve 1 according to the first embodiment of the present invention when viewed from a valve body side (base end side) (cross-sectional view taken along A-A in FIG. 2).

Next, the configuration of the nozzle plate 6 will be described with reference to FIG. 3. FIG. 3 is a diagram showing the nozzle plate 6 of the fuel injection valve 1 according to the first embodiment of the present invention when viewed from the valve body side (base end side) (cross-sectional view taken along A-A in FIG. 2). The cross section of the nozzle plate 6 in FIG. 2 is a cross section taken along the straight line B-B in FIG. 3.

In FIG. 3, an axis passing through a center O1 of the nozzle plate 6 and extending in a lateral direction of a paper of FIG. 3 is defined as an X1 axis, and an axis passing through the center O1 of the nozzle plate 6 and extending in a longitudinal direction of FIG. 3 perpendicular to the X1 axis is defined as a Y1 axis. The X1 axis and the Y1 axis set the center O1 as an origin point and intersect perpendicularly at the center O1. That is, a straight line obtained by projecting a first plane including the central axis line 1*a* onto a virtual plane perpendicular to the central axis line 1*a* is defined as the Y1 axis, and a straight line obtained by projecting a second plane including the central axis line 1*a* and perpendicularly intersecting the first plane onto the virtual plane perpendicular to the central axis line 1*a* is defined as the X1 axis.

The nozzle plate 6 is provided with introduction passages 11*a*-1, 11*a*-2, 11*b*-1, 11*b*-2, 11*c*-1, 11*c*-2, 11*d*-1, and 11*d*-2 extending outwardly in a radial direction from the center of the nozzle plate 6, and downstream sides of each introduction passage are provided with each spray hole 13*a*-1, 13*a*-2, 13*b*-1, 13*b*-2, 13*c*-1, 13*c*-2, 13*d*-1, and 13*d*-2 through which fuel is injected to the outside.

The introduction passage 11*a*-1 and the spray hole 13*a*-1 are collectively defined as a fuel injection passage 10A1. Similarly, the introduction passage 11*b*-1 and the spray hole 13*b*-1 together constitute a fuel injection passage 10A2, the introduction passage 11*c*-1 and the spray hole 13*c*-1 together constitute a fuel injection passage 10A3, and the introduction passage 11*d*-1 and the spray hole 13*d*-1 together constitute a fuel injection passage 10A4.

The fuel injected from the fuel injection passages 10A1 to 10A4 forms one spray (spray group) directed in the same direction (the positive direction of the X1 axis).

Similarly, the introduction passage 11*a*-2 and the spray hole 13*a*-2 together constitute a fuel injection passage 10B1, the introduction passage 11*b*-2 and the spray hole 13*b*-2 together constitute a fuel injection passage 10B2, the introduction passage 11*c*-2 and the spray hole 13*c*-2 together constitute a fuel injection passage 10B3, and the introduction passage 11*d*-2 and the spray hole 13*d*-2 together constitute a fuel injection passage 10B4.

The fuel injected from the fuel injection passages 10B1 to 10B4 forms one spray (spray group) directed in the same direction (the negative direction of the X1 axis).

That is, in the present embodiment, the plurality of fuel injection passages 10A1 to 10A4 and 10B1 to 10B4 are configured to include a plurality of fuel injection passages through which fuel is sprayed in a first direction and a plurality of fuel injection passages through which fuel is sprayed in a second direction different from the first direction.

In the first embodiment, the fuel injection passage 10A1 including the spray hole 13*a*-1 and the fuel injection passage 10A2 including the spray hole 13*b*-1 are disposed in a first quadrant, the fuel injection passage 10B1 including the spray hole 13*a*-2 and the fuel injection passage 10B2 including the spray hole 13*b*-2 are disposed in a second quadrant, the fuel injection passage 10B3 including the spray hole 13*c*-2 and the fuel injection passage 10B4 including the spray hole 13*d*-2 are disposed in a third quadrant, and the fuel injection passage 10A3 including the spray hole 13*c*-1 and the fuel injection passage 10A4 including the spray hole 13*d*-1 are disposed in a fourth quadrant, on a coordinate plane constituted by the X1 axis and the Y1 axis.

When the introduction passages 11*a*-1, 11*a*-2, 11*b*-1, 11*b*-2, 11*c*-1, 11*c*-2, 11*d*-1, and 11*d*-2 do not need to be distinguished, they will be simply referred to as the introduction passage 11 and described. Similarly, when the fuel injection passages and the spray holes do not need to be distinguished, they will be referred to as the fuel injection passage 10 and the spray hole 13 and described.

In the present embodiment, the fuel injection passage 10A1 and the fuel injection passage 10A4 are a surface (surface including the X1 axis) which is parallel to the X1 axis and passes through the X1 axis and are formed in a surface symmetry with respect to a surface (a surface including the X1 axis and the central axis line 1*a*) which is parallel to the center axis line 1*a* and is perpendicular to a paper passing through the central axis line 1*a*. The fuel injection passage 10A2 and the fuel injection passage 10A3 are a surface (surface including the X1 axis) which is parallel to the X1 axis and passes through the X1 axis and are formed in a surface symmetry with respect to a surface (a surface including the X1 axis and the central axis line 1*a*) which is parallel to the center axis line 1*a* and is perpendicular to a paper passing through the central axis line 1*a*.

The fuel injection passage 10B1 and the fuel injection passage 10B4 are a surface (surface including the X1 axis) which is parallel to the X1 axis and passes through the X1 axis and are formed in a surface symmetry with respect to a surface (a surface including the X1 axis and the central axis line 1*a*) which is parallel to the center axis line 1*a* and is perpendicular to a paper passing through the central axis line 1*a*. The fuel injection passage 10B2 and the fuel injection passage 10B3 are a surface (surface including the X1 axis) which is parallel to the X1 axis and passes through the X1 axis and are formed in a surface symmetry with respect to a surface (a surface including the X1 axis and the central axis line 1*a*) which is parallel to the center axis line 1*a* and is perpendicular to a paper passing through the central axis line 1*a*.

In addition, in the present embodiment, the fuel injection passage 10A1 and the swirl fuel injection passage 10B1 are a surface (surface including the Y1 axis) which is parallel to the Y1 axis and passes through the Y1 axis and are formed in a surface symmetry with respect to a surface (a surface including the Y1 axis and the central axis line 1*a*) which is parallel to the center axis line 1*a* and is perpendicular to a paper passing through the central axis line 1*a*. The fuel injection passage 10A2 and the fuel injection passage 10B2 are a surface (surface including the Y1 axis) which is parallel to the Y1 axis and passes through the Y1 axis and are formed in a surface symmetry with respect to a surface (a surface including the Y1 axis and the central axis line 1*a*) which is parallel to the center axis line 1*a* and is perpendicular to a paper passing through the central axis line 1*a*. The fuel injection passage 10A3 and the fuel injection passage 10B3 are a surface (surface including the Y1 axis) which is parallel to the Y1 axis and passes through the Y1 axis and are formed in a surface symmetry with respect to a surface (a surface including the Y1 axis and the central axis line 1*a*) which is parallel to the center axis line 1*a* and is perpendicular to a paper passing through the central axis line 1*a*.

The fuel injection passage 10A4 and the fuel injection passage 10B4 are a surface (surface including the Y1 axis) which is parallel to the Y1 axis and passes through the Y1 axis and are formed in a surface symmetry with respect to a surface (a surface including the Y1 axis and the central axis line 1*a*) which is parallel to the center axis line 1*a* and is perpendicular to a paper passing through the central axis line 1*a*.

The spray hole group constituted by the spray holes 13*a*-1, 13*b*-1, 13*c*-1, and 13*d*-1 is defined as a first spray hole group, and the spray hole group constituted by the spray holes 13*a*-2, 13*b*-2, 13*c*-2, and 13*d*-2 is defined as a second spray hole group. The spray holes 13*a*-1, 13*b*-1, 13*c*-1, and 13*d*-1 of the first spray hole group inject fuel in one direction as a whole to form a first fuel spray. The spray holes 13*a*-2, 13*b*-2, 13*c*-2, and 13*d*-2 of the second spray hole group 13B inject fuel in one direction different from the second spray hole group as a whole to form a second fuel spray.

In the present embodiment, as described above, since the fuel injection passages 10A1 to 10A4 and the fuel injection passages 10B1 to 10B4 are formed in a surface symmetry with respect to the surface including the Y1 axis and the central axis line 1*a*, the first fuel spray and the second fuel spray form a spray in a surface symmetry with respect to the surface including the Y1 axis and the central axis line 1*a*. If it is desired to form a spray so that the first fuel spray and the second fuel spray are asymmetrical with respect to the surface including the Y1 axis and the central axis line 1*a*, the fuel injection passages 10A1 to 10A4 and the fuel injection passages 10B1 to 10B4 may be formed asymmetrically with respect to the plane including the Y1 axis and the central axis line 1*a*. Further, in this case, the fuel injection passages 10A1, 10A2, 10B1, and 10B2 and the fuel injection passages 10A4, 10A3, 10B4, and 10B3 may be formed asymmetrically with respect to the surface including the X1 axis and the central axis line 1*a*.

The configuration of the fuel injection passage 10A1 will be described in detail with reference to FIG. 4A.

Figure 4A:
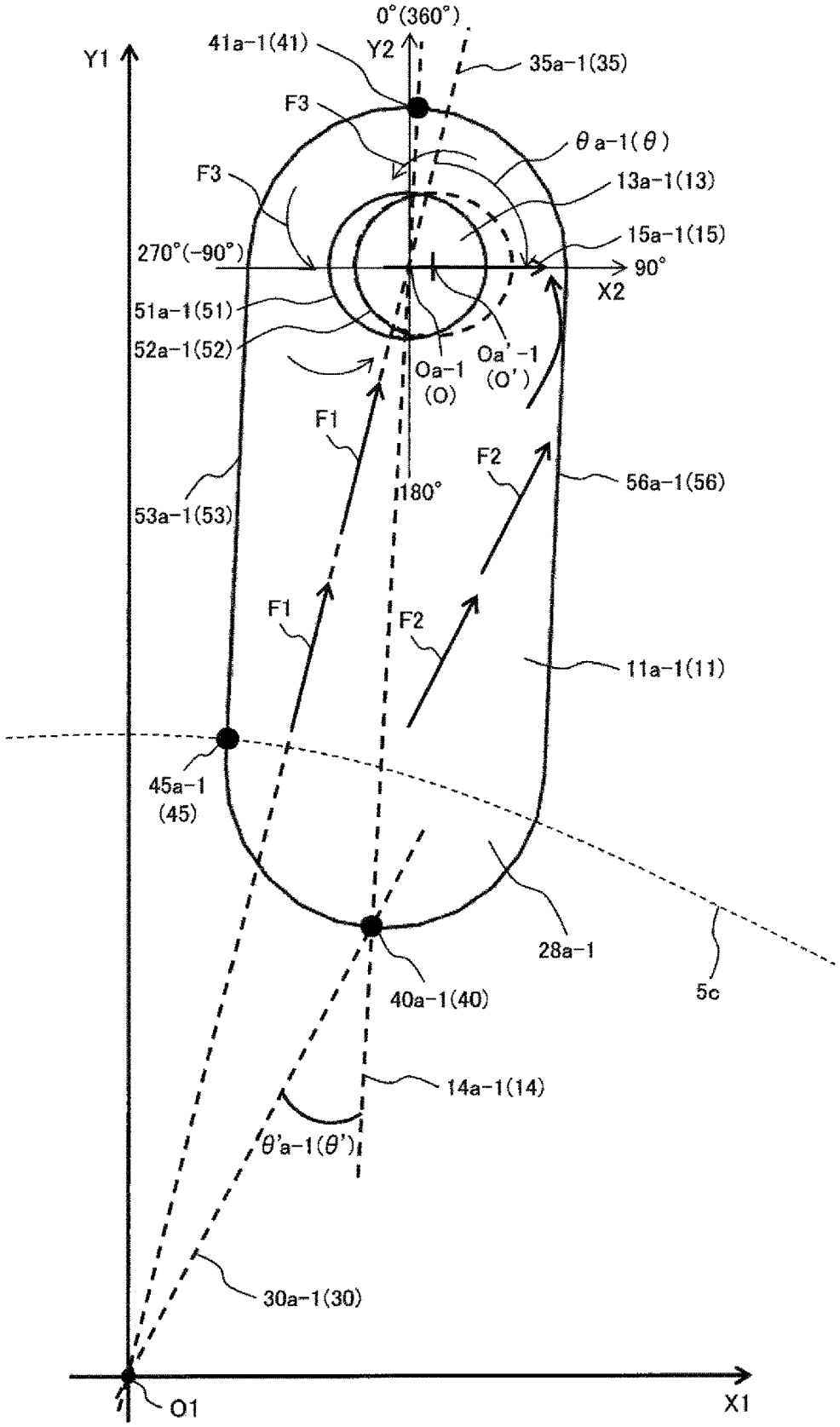
FIG. 4A is a view showing aspects of flows F1, F2, and F3 in a fuel injection passage 10A1 (10) according to the first embodiment of the present invention.

FIG. 4A is a view showing aspects of flows F1, F2, and F3 in the fuel injection passage 10A1 (10) according to the first embodiment of the present invention. Although FIG. 4A shows the configuration of the fuel injection passage 10A1, the fuel injection passages 10A2 to 10A4 and the fuel injection passages 10B1 to 10B4 also have the same configuration and operation and effect.

The introduction passage 11*a*-1 (11) and the spray hole 13*a*-1 (13) are configured as follows.

First, a central line 14*a*-1 (14) of the introduction passage 11*a*-1 is defined. The central line 14*a*-1 is a line segment passing through a center in a width direction of the introduction passage 11*a*-1. A point close to the center O1 of the nozzle plate 6 at an intersection point between the central line and the introduction passage 11*a*-1 is defined as 40*a*-1 (40), and a point far from the center O1 of the nozzle plate 6 is defined as 41*a*-1 (41). The point 40*a*-1 is positioned on an upstream side in a flow direction of fuel, and the point 41*a*-1 is positioned on a downstream side in the flue flow of fuel. That is, the point 40*a*-1 is a central point of an upstream side end portion of the introduction passage 11*a*-1, and the point 41*a*-1 is a central point of a downstream side end portion of the introduction passage 11*a*-1. A straight line passing through the intersection point 40*a*-1 and the center O1 of the nozzle plate 6 is defined as 30*a*-1 (30). In the present embodiment, the introduction passage 11*a*-1 is rotated by a predetermined angle θ'*a*-1 counterclockwise based on the intersection point 40*a*-1. That is, the central line 14*a*-1 of the introduction passage 11*a*-1 is formed so that the intersection point 41*a*-1 is positioned on the Y1 axis side with respect to a straight line 30*a*-1 based on the intersection point 40*a*-1. At this time, on the side surface of the introduction passage 11*a*-1, a side surface which is away from the Y1 axis is defined as a side surface 56*a*-1 (56). In addition, the other side surface is defined as a side surface 53*a*-1 (53).

According to this configuration, a flow F1 directly flowing mainly into the spray hole with respect to the spray hole 13*a*-1 and a flow F2 flowing along a side surface 56*a*-1 are generated in the fuel introduced from the fuel introduction port 28*a*-1, and a swirling flow F3 around the spray hole 13*a*-1 is generated by the flow F2 flowing along the side surface 56*a*-1.

Next, an inclination direction of the spray hole 13*a*-1 will be described. A straight line passing through the center O1 of the nozzle plate 6 and a center Oa-1 (O) of the inlet cross section of the spray hole 13*a*-1 is defined as a straight line 35*a*-1 (35). A projection straight line (arrow) obtained by projecting a straight line passing through a center Oa-1 of a spray hole inlet cross section 51*a*-1 (51) and passing through a center Oa'-1 (0') of a spray hole outlet cross section 52*a*-1 (52) onto an end surface (surface perpendicular to the central axis line 1*a*) of the nozzle plate 6 is defined as an inclination direction 15*a*-1 (15) of a spray hole. Here, in order to define the inclination direction 15*a*-1 of the spray hole, with respect to an X1-Y1 orthogonal coordinate system (first orthogonal coordinate system), a second orthogonal coordinate system (X2-Y2 orthogonal coordinate system) is defined. In the X2-Y2 orthogonal coordinate system, an X2 axis is parallel to the X1 axis and a Y2 axis is parallel to the Y1 axis. In addition, an origin point of the X2-Y2 orthogonal coordinate system is the center Oa-1 (O) of the spray hole inlet cross section. At this time, a direction passing through the center Oa-1 of the spray hole inlet cross section and along the Y1 axis the direction being away from an origin point (center of the nozzle plate 6) O1 of the X1-Y1 orthogonal coordinate system is set to be 0°, and an angular direction rotating from an angular position of 0° toward the side on which an absolute value of X1 in a quadrant in which the spray hole exists is increased is defined as a positive angular direction. At this time, an angle (the inclination angle of the spray hole) formed by the inclination direction 15*a*-1 of the spray hole from the angular position of 0° is set to be θa-1 (θ). For other introduction passages and spray holes, the inclination direction of the spray hole is defined in the same way.

In the following description, when the fuel injection passages 10A2 to 10A4 and the fuel injection passages 10B1 to 10B4 are not distinguished, the inclination direction 15*a*-1, the inclination angle θa-1, and the rotation angle θ'*a*-1 are simply described as the inclination direction 15, the inclination angle θ and the rotation angle θ'. In addition, reference numerals with parentheses described above and below are reference numerals attached to each portion when the fuel injection passages 10A2 to 10A4 and 10B1 to 10B4 are not distinguished.

In the present embodiment, the introduction passage 11 and the spray hole 13 are configured so that 0<θa-1 (inclination angle of the spray hole 13*a*-1)<180°, 0<θb-1 (inclination angle of the spray hole 13*b*-1)<180°, 0<θc-1 (inclination angle of the spray hole 13*c*-1)<180°, 0<θd-1 (inclination angle of the spray hole 13*d*-1)<180°, 0<θa-2 (inclination angle of the spray hole 13*a*-2)<180°, 0<θb-2 (inclination angle of the spray hole 13*b*-2)<180°, 0<θc-2 (inclination angle of the spray hole 13*c*-2)<180°, 0<θd-2 (inclination angle of the spray hole 13*d*-2)<180°.

According to this configuration, as described above, the flow F1 directly flowing in the spray hole is generated, and the swirling flow F3 is generated by the flow F2 flowing along the side surface 56*a*-1. Here, in order to explain an aspect in which the flows F1 and F3 flow in the spray hole, a third orthogonal coordinate system (X3-Y3 orthogonal coordinate system) is defined as shown in FIG. 4B.

Figure 4B:
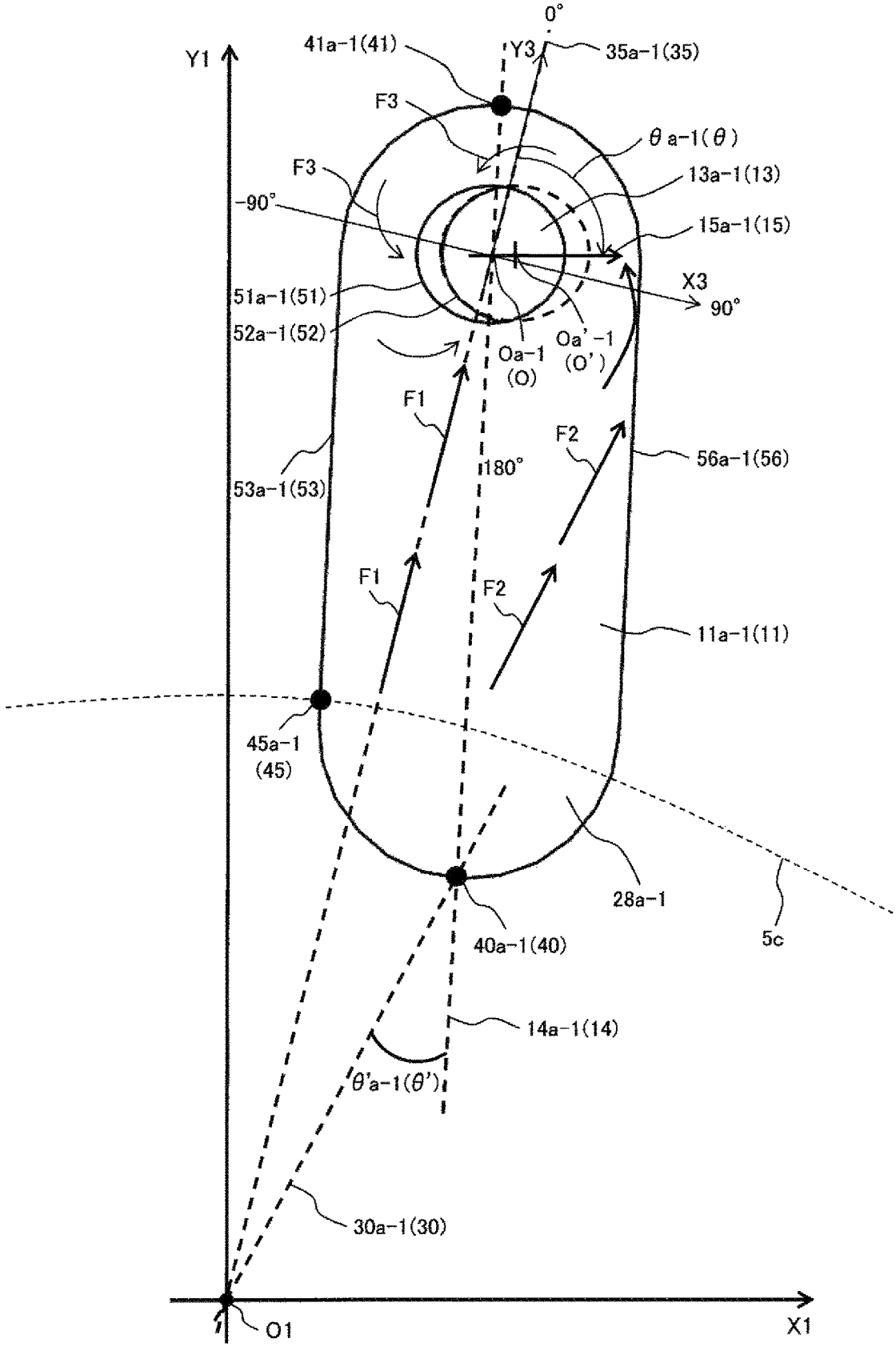
FIG. 4B is a diagram showing a third orthogonal coordinate system defined on a plane parallel to the nozzle plate 6.

FIG. 4B is a diagram showing the third orthogonal coordinate system defined on a surface (a surface perpendicular to the central axis line 1*a*) parallel to the nozzle plate 6. In the X3-Y3 orthogonal coordinate system, a Y3 axis overlaps (coincides with) the straight line 35*a*-1 (35) and the X3 axis is perpendicular to the Y3 axis. In addition, an origin point of the X3-Y3 orthogonal coordinate system is the center Oa-1 (O) of the spray hole inlet cross section. At this time, a direction passing through the center Oa-1 of the spray hole inlet cross section and along the straight line 35*a*-1, the direction being away from an origin point (center of the nozzle plate 6) O1 of the X1-Y1 orthogonal coordinate system is set to be 0°, and an angular direction rotating from an angular position of 0° toward the side on which an absolute value of X1 in a quadrant in which the spray hole exists is increased is defined as a positive angular direction. For other introduction passages and spray holes, the X3-Y3 orthogonal coordinate system is defined in the same way.

The fuel collides with an inner wall of the spray hole 13*a*-1, mainly a portion of −90° to 90° of the X3-Y3 orthogonal coordinate system, by the flow F1 directly flowing in the spray hole, and the fuel is thinly spread mainly in the vicinity of 180° to 360° of the X3-Y3 orthogonal coordinate system of the inner wall of the spray hole 13*a*-1 by the action of the swirling flow F3. Since the inclination direction of the spray hole is toward 15*a*-1, fuel is further pressed against the inner wall of the spray hole 13*a*-1 while it flows in the nozzle hole 13*a*-1 in the spray hole output direction, thereby promoting thinness. The atomization of fuel is greatly affected by the degree of the thinness in the spray hole, and the fuel is easily atomized as the thinness is progressed. According to the present configuration, the thinness can be promoted in the spray hole by the action of the swirling flow F3 induced by the flow F1 directly flowing in the spray hole 13*a*-1 and the flow F2 flowing along the side surface 56*a*-1, and the thinness can be further promoted and the atomization of the fuel can be promoted by setting the inclination direction of the spray hole in the above-described direction.

On the other hand, when a spread angle of the fuel discharged from the spray hole is set to be a spray angle, it is possible to suppress the increase of the spray angle according to the configuration of the present embodiment. For example, in the atomization method mainly using the swirling flow described in JP 2003-336562 A (PTL 1), since a large swirling force is applied to the fuel in the spray hole, there is a problem in that the fuel discharged from the spray hole radially spreads under the spray hole and the spray angle becomes very large. That is, the spray angle tends to increase as the swirling force increases. In addition, for example, in the configuration disclosed in JP 2016-70070 A (PTL 3), the flow that flows in the spray hole is mainly the swirling flow, the inclination direction of the spray hole is also opposite to that of the present embodiment, and the fuel in the spray hole is injected outside the spray hole without colliding with the inner wall surface of the spray hole. Therefore, the large swirling force is applied, and as described above, the spray angle tends to increase under the spray hole. However, as in the present embodiment, by using the flow F1 directly flowing in the spray hole 13*a*-1 and the swirling flow F3 and further appropriately setting the inclination direction of the spray hole, it is possible to promote the collision of fuel with the inner wall surface of the spray hole, promote the atomization of the fuel without increasing the swirling force more than necessary and suppress the spray angle.

Particularly, in the present embodiment, in order to use the flow F1 directly flowing in the spray hole and the swirling flow F3, it is desirable that a part of the fuel introduction port 28*a*-1 (the portion surrounded by an outline curve of the introduction passage 11*a*-1 in FIG. 4A and a curve (broken line in FIG. 4A) showing an opening portion 5C) is configured to overlap the straight line 35*a*-1. In addition, when the intersection point close to the straight line 35*a*-1 at the intersection point between the curve 5C and the introduction passage 11*a*-1 is set to be a point 45*a*-1, it is desirable that a distance between the straight line 35*a*-1 and the point 45*a*-1 is ¼ or more of the diameter of the spray hole 13*a*-1. In this case, it is possible to sufficiently secure the flow F1 directly flowing in the spray hole 13*a*-1, and it is possible to promote the atomization and suppress the spray angle by the action of both of the directly flowing flow F1 and the swirling flow F3.

In addition, it is desirable that the distance between the intersection point 40*a*-1 and the intersection point 41*a*-1 is three times or more the diameter of the spray hole 13*a*-1. In addition, it is desirable that the distance is five times or more the diameter of the spray hole 13*a*-1. With this arrangement, the fuel inflowing from the fuel introduction port 28*a*-1 is sufficiently rectified until it flows in the spray hole 13*a*-1, and the flow F1 directly flowing in the spray hole 13*a*-1 and the swirling flow F3 are easily generated. In the configuration disclosed in PTLs 2 and 3, this distance is short and it cannot be said that the consideration for obtaining a sufficient rectifying effect is sufficient.

In addition, in the configuration disclosed in the first embodiment, since the swirling chamber is not provided as in the configuration disclosed in PTL 1, the processing is facilitated, and the sufficient atomization and a narrow-angle effect of the spray angle can be obtained with the simple configuration.

In the first embodiment, the side surfaces 53*a*-1 and 56*a*-1 each have a linear portion (plane shape portion), and linear portions of each side surface 53*a*-1 and 56*a*-1 are disposed in parallel. However, these linear portions do not have a linear portion, and for example, the whole thereof may be constituted by a curved portion.

Figure 5:
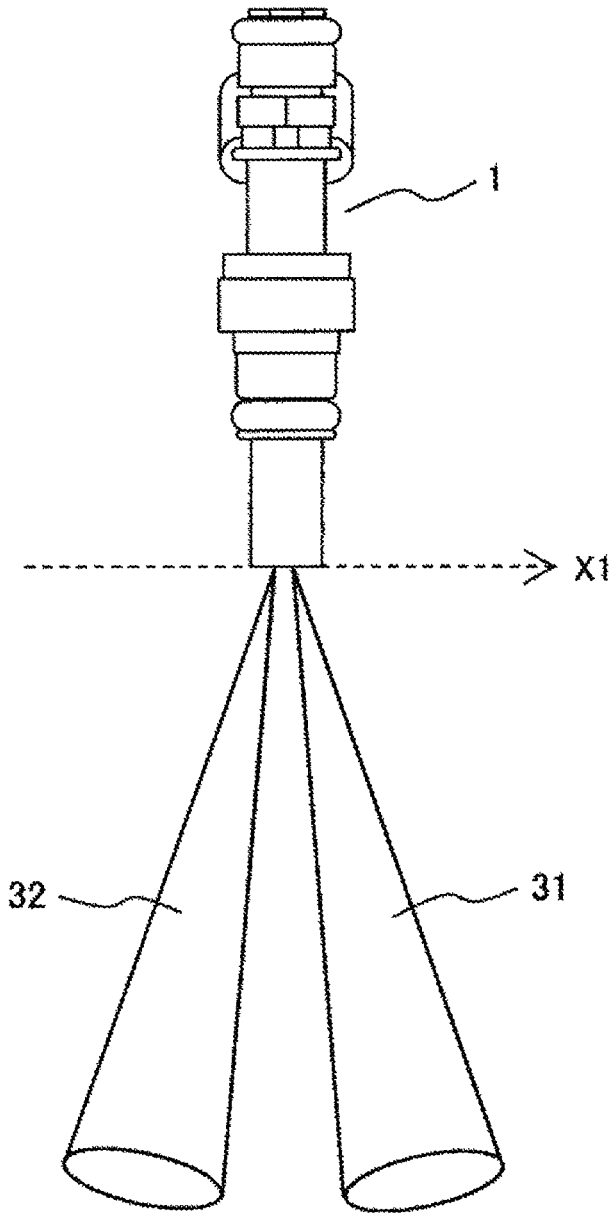
FIG. 5 is a diagram showing a spray form of the fuel injection valve 1 according to the first embodiment of the present invention when viewed from a Y1 axis direction.
Figure 6:
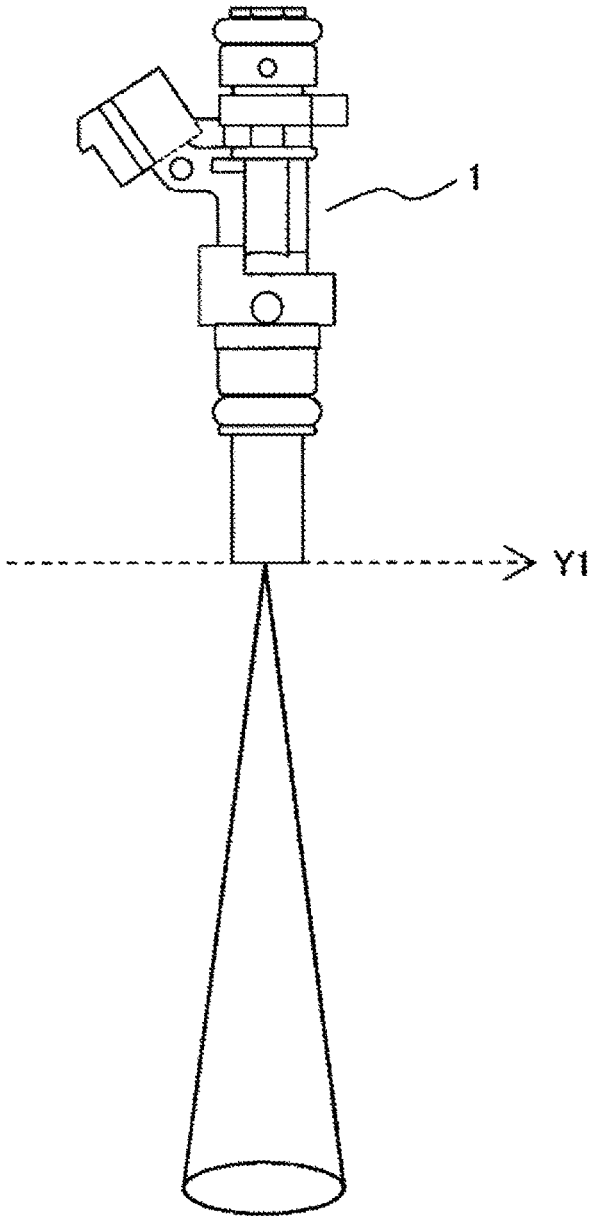
FIG. 6 is a view showing a spray form of the fuel injection valve 1 according to the first embodiment of the present invention when viewed from an X1 axis direction.

Next, a form of spray injected from the fuel injection valve 1 will be described with reference to FIGS. 5 and 6. FIG. 5 is a diagram showing a spray form of the fuel injection valve 1 according to the first embodiment of the present invention when viewed from a Y1 axis direction. FIG. 6 is a diagram showing the spray form of the fuel injection valve 1 according to the first embodiment of the present invention when viewed from an X1 axis direction.

In the configuration of the present embodiment, the fuel passing through the spray holes 13*a*-1, 13*b*-1, 13*c*-1, and 13*d*-1 forms a first spray 31 directed in the first direction, and the fuel passing through the spray holes 13*a*-2, 13*b*-2, 13*c*-2, and 13*d*-2 forms a second spray 32 directed in a direction different from the first direction. That is, the plurality of fuel injection passages 10 are divided into the first fuel injection passage groups 10A1 to 10A4 forming the first spray 31 and the second fuel injection passage groups 10B1 to 10B4 forming the second spray 32.

In addition, when viewed from the +X1 direction, a one-way spray is formed as shown in FIG. 6. Thus, according to the configuration of the present embodiment, a two-way spray can be formed.

As described above, in the present embodiment, the fuel injection valve has the following configuration. First, the nozzle plate 6 and the first direction and the second direction in which the fuel spray is directed are projected onto the virtual plane perpendicular to the central axis line 1*a*, the first orthogonal coordinate system which has the X1 axis passing through the center O1 of the nozzle plate 6 and along the first direction and the Y1 axis passing through the center O1 of the nozzle plate 6 and perpendicular to the X1 axis is virtualized on the virtual plane. In the present embodiment, the virtual plane may be considered to be an upper end surface of the nozzle plate 6. All the plurality of fuel injection passages 10A1 to 10A4 and 10B1 to 10B4 are inclined so that the straight line segment 14 connecting between the central point 40 of the upstream side end portion of the introduction passage 11 and the center O of the inlet opening surface of the fuel injection hole 13 is positioned on the Y1 axis side with respect to the straight line 35 passing through the central point 40 and the center O1 of the nozzle plate 6. That is, all the fuel injection passages 10A1 to 10A4 and 10B1 to 10B4 are configured as the inclined fuel injection passages in which the straight line segment 14 connecting between the central point 40 of the upstream side end portion of the introduction passage 11 and the center O of the inlet opening surface of the fuel injection hole 13 is positioned on the Y1 axis side with respect to the straight line 30 passing through the central point 40 and the center O1 of the nozzle plate 6.

The straight line segment 14 connecting between the center point 40 of the upstream side end portion of the introduction passage 11 and the center O of the inlet opening surface of the fuel injection hole 13 means a portion between the central point 40 of the straight line 14 and the center O of the inlet opening surface.

Second Embodiment

Figure 7:
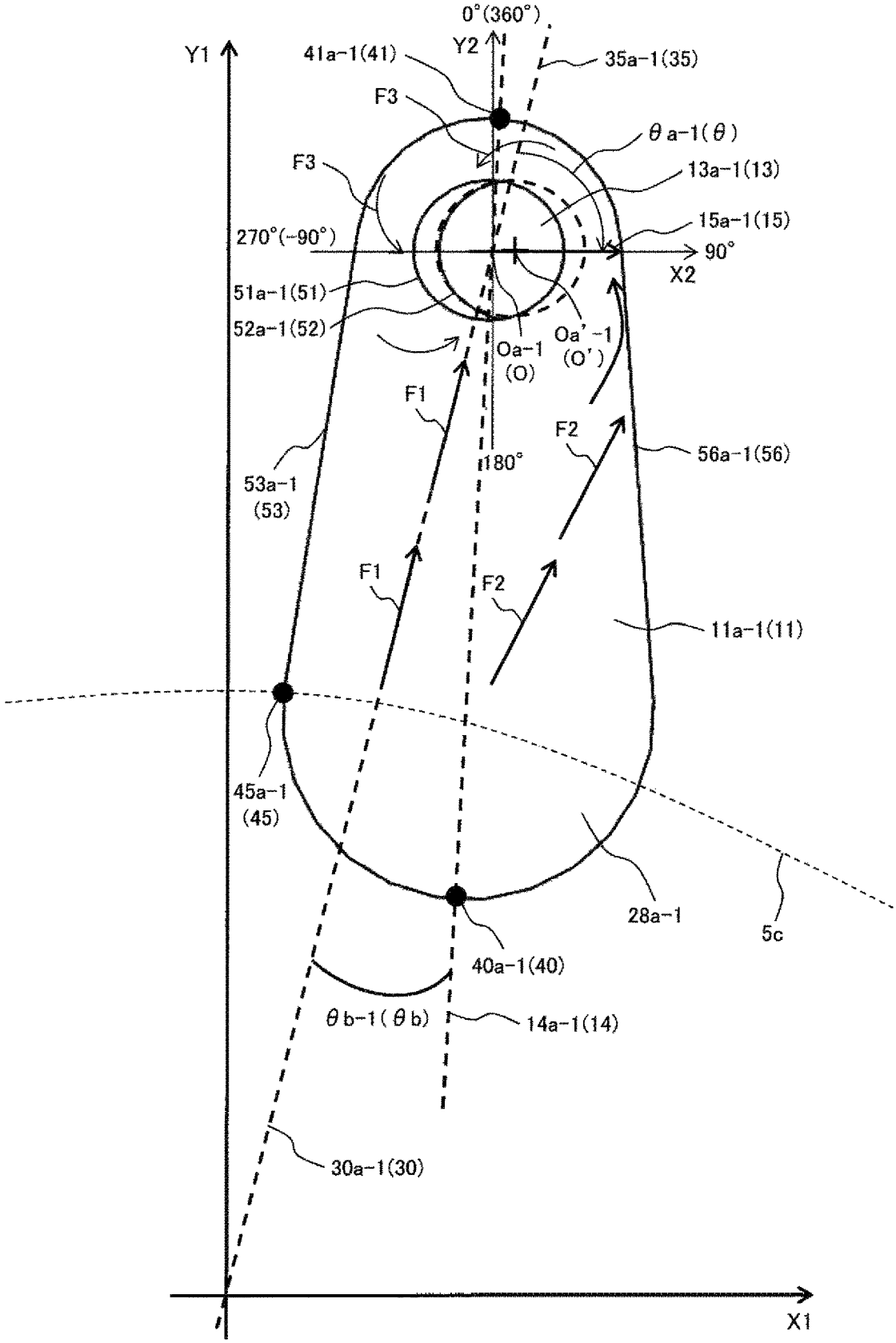
FIG. 7 is an enlarged view of the vicinity of a fuel injection passage 10A1 (10) according to a second embodiment of the present invention.

Next, a second embodiment according to the present invention will be described with reference to FIG. 7. FIG. 7 is an enlarged view of the vicinity of a fuel injection passage 10A1 (10) according to the second embodiment of the present invention.

A difference between the present embodiment and the first embodiment is that side surfaces 53*a*-1 and 56*a*-1 of an introduction passage 11*a*-1 are not parallel to each other, and a width of the introduction passage 11*a*-1 is narrowed from upstream to downstream. Other configurations are the same as those of the first embodiment.

According to this configuration, the fuel flowing from the fuel introduction port 28*a*-1 toward the introduction passage 11*a*-1 is accelerated toward a downstream as the flow F1 directly flowing in the spray hole 13*a*-1 and the flow F2 flowing along the side surface 56*a*-1 are increased and the width of the flow path is narrowed toward the downstream. Therefore, the collision force on the inner wall of the spray hole 13*a*-1 by the flow F1 is further increased, the swirling force by the swirling flow F3 is also increased, and the atomization effect is improved.

In addition, in the present embodiment, the side surface 56*a*-1 and the side surface 53*a*-1 are configured to be surface symmetrical with each other with respect to the surface passing through the central line 14*a*-1 and perpendicular to a paper, but the side surface 56*a*-1 and the side surface 53*a*-1 may not be surface symmetrical with each other.

For example, the side surface 53*a*-1 may be configured to be parallel to a surface passing through the central line 14*a*-1 and perpendicular to a paper and the side surface 56*a*-1 may be configured to be a surface inclined by a predetermined angle as shown in FIG. 7. In this case, as compared with the configuration described in the first embodiment, the flow F2 flowing along the side surface 56*a*-1 is increased, the swirling force by the swirling flow F3 is increased, and the atomization effect is further promoted. It should be noted that the side surface 53*a*-1 may be inclined at an angle different from that of the side surface 56*a*-1 with respect to a surface passing through the central line 14*a*-1 and perpendicular to a paper.

In addition, on the contrary, the side surface 56*a*-1 may be configured to be parallel to a surface passing through the central line 14*a*-1 and perpendicular to a paper and the side surface 53*a*-1 may be configured to be a surface inclined by a predetermined angle as shown in FIG. 7. In this case, as compared with the configuration described in the first embodiment, the flow F1 directly flowing into the spray hole 13*a*-1 is increased, the collision force on the inner wall of the spray hole 13*a*-1 is increased, and the atomization effect is promoted. The side surface 56*a*-1 may be inclined at an angle different from that of the side surface 56*a*-1 with respect to a surface passing through the central line 14*a*-1 and perpendicular to a paper.

When an inclination angle of the side surface 53*a*-1 and an inclination angle of the side surface 56*a*-1 are adjusted so as to be a different angle in a symmetrical or asymmetrical form with respect to a surface passing through the central line 14*a*-1 and perpendicular to a paper, a ratio of the flow F1 flowing in the spray hole 13*a*-1 and the swirling flow F3 can be changed, and the spray angle can be adjusted with accuracy.

In the present embodiment, the side surface 53*a*-1 and the straight line 56*a*-1 are described as straight lines, but they may be curved lines.

Third Embodiment

Figure 8:
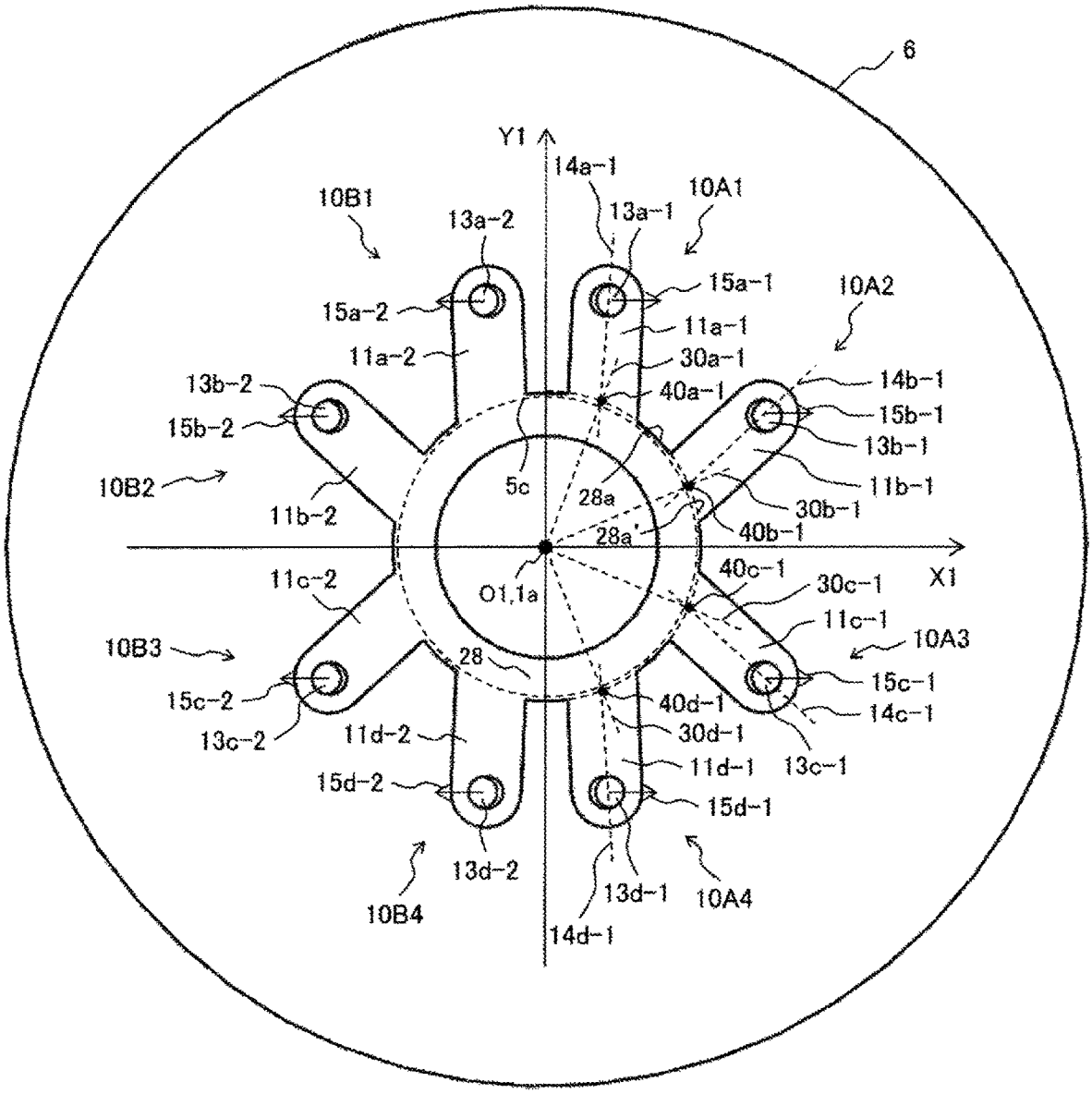
FIG. 8 is a diagram showing a nozzle plate 6 of a fuel injection valve 1 according to a third embodiment of the present invention when viewed from a valve body side (base end side).

Next, a third embodiment according to the present invention will be described with reference to FIG. 8. FIG. 8 is a diagram showing a nozzle plate 6 of a fuel injection valve 1 according to the third embodiment of the present invention when viewed from a valve body side (base end side).

A difference between the present embodiment and the first embodiment is that the fuel introduction port 28 is connected on the upstream side of all the introduction passages 11. Other configurations are the same as those of the first embodiment.

In the case of the present embodiment, points 40*a*-1, 40*b*-1, 40*c*-1, and 40*d*-1 which constitute upstream end portions of introduction passages 11*a*-1, 11*b*-1, 11*c*-1, and 11*d*-1 are intersection points between an extension line 28*a*' obtained by extending an outer peripheral edge 28*a* of the fuel introduction port 28 to inlet portions of the introduction passages 11*a*-1, 11*b*-1, 11*c*-1, and 11*d*-1 and central lines 14*a*-1, 14*b*-1, 14*c*-1, and 14*d*-1 of the introduction passages 11*a*-1, 11*b*-1, 11*c*-1, and 11*d*-1.

Straight lines 30*a*-1, 30*b*-1, 30*c*-1 and 30*d*-1 passing through the intersection points 40*a*-1, 40*b*-1, 40*c*-1, and 40*d*-1 and a center O1 of the nozzle plate 6 are configured as shown in FIG. 8, and the introduction passages 11*a*-1, 11*b*-1, 11*c*-1, and 11*d*-1 are provided in a rotated (inclined) state similarly as described with reference to the introduction passage 11*a*-1 of FIG. 4A with respect to the straight lines 30*a*-1, 30*b*-1, 30*c*-1, and 30*d*-1.

The fuel injection passages 10B1 to 10B4 are configured similar to the fuel injection passages 10A1 to 10A4, and disposed axis-symmetrically with the fuel injection passages 10A1 to 10A4 with respect to the Y1 axis.

According to this configuration, since a volume of the fuel introduction port 28 is increased, there is an effect that a flow path resistance at the fuel introduction port 28 is decreased and fuel tends to flow in the introduction passages 11 uniformly. Therefore, there is an effect that the fuel injected from each spray hole 13 becomes uniform.

Fourth Embodiment

Figure 9:
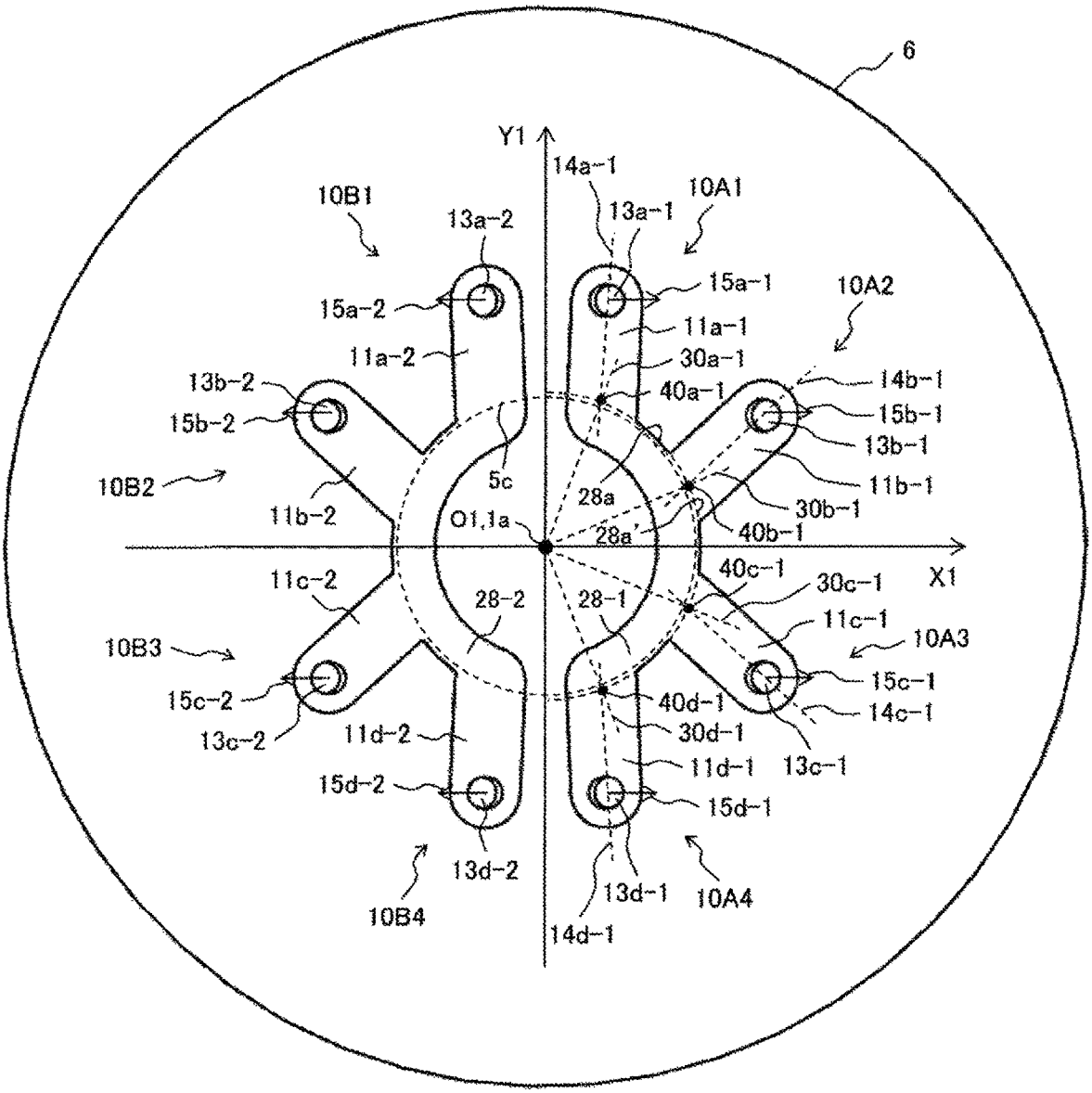
FIG. 9 is a diagram showing a nozzle plate 6 of a fuel injection valve 1 according to a fourth embodiment of the present invention when viewed from a valve body side (base end side).

Next, a fourth embodiment according to the present invention will be described with reference to FIG. 9. FIG. 9 is a diagram showing a nozzle plate 6 of a fuel injection valve 1 according to the fourth embodiment of the present invention when viewed from a valve body side (base end side).

A difference between the present embodiment and the first embodiment is that the fuel introduction port 28-1 is connected to the upstream sides of the introduction passages 11*a*-1, 11*b*-1, 11*c*-1, and 11*d*-1, and the fuel introduction port 28-2 is connected to the upstream sides of the introduction passages 11*a*-2, 11*b*-2, 11*c*-2, and 11*d*-2. The fuel introduction port 28-1 and the fuel introduction port 28-2 are divided on the nozzle plate 6, and each of them is configured as an independent fuel passage.

In the case of the present embodiment, points 40*a*-1, 40*b*-1, 40*c*-1, and 40*d*-1 constituting upstream side end portions of introduction passages 11*a*-1, 11*b*-1, 11*c*-1, and 11*d*-1 are configured similar to those of the third embodiment. The fuel injection passages 10B1 to 10B4 are configured similar to the fuel injection passages 10A1 to 10A4, and disposed axis-symmetrically with the fuel injection passages 10A1 to 10A4 with respect to the Y1 axis.

According to this configuration, the fuel flowing in the fuel introduction port 28-1 tends to flow in the introduction passages 11*a*-1, 11*b*-1, 11*c*-1, and 11*d*-1 uniformly, whereas the fuel flowing in the fuel introduction port 28-2 tends to flow in introduction passages 11*a*-2, 11*b*-2, 11*c*-2, and 11*d*-2 uniformly. Therefore, there is an effect that fuel injected from spray holes 13*a*-1, 13*b*-1, 13*c*-1, and 13*d*-1 becomes uniform, and fuel injected from spray holes 13*a*-2, 13*b*-2, 13*c*-2, and 13*d*-2 becomes uniform.

Fifth Embodiment

Figure 10:
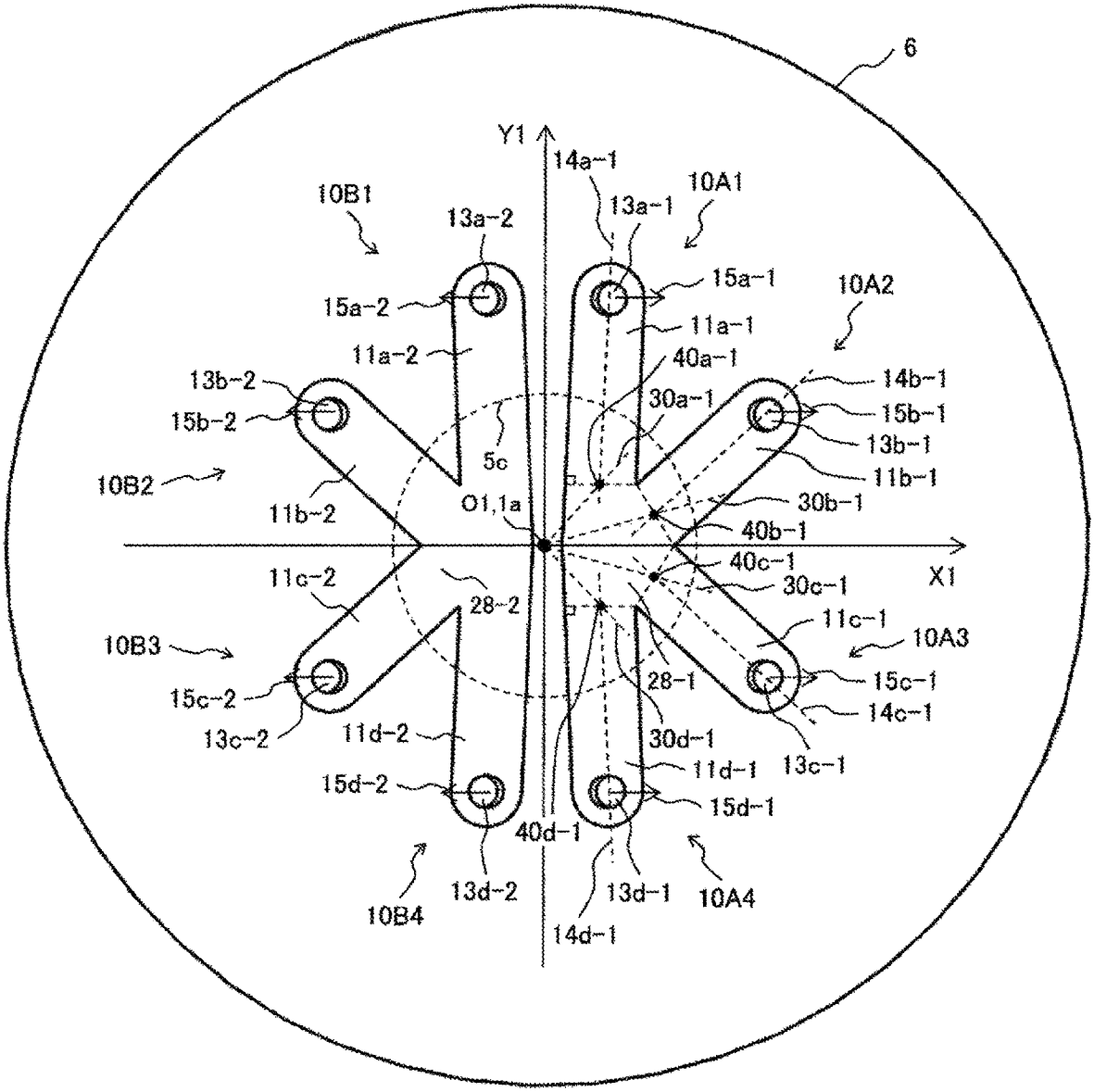
FIG. 10 is a diagram showing a nozzle plate 6 of a fuel injection valve 1 according to a fifth embodiment of the present invention when viewed from a valve body side (base end side).

Next, a fifth embodiment according to the present invention will be described with reference to FIG. 10. FIG. 10 is a diagram showing a nozzle plate 6 of a fuel injection valve 1 according to the fifth embodiment of the present invention when viewed from a valve body side (base end side).

A difference between the present embodiment and the first embodiment is that upstream sides of introduction passages 11*a*-1, 11*b*-1, 11*c*-1, and 11*d*-1 extend toward a center O1 of the nozzle plate 6, and each of them is connected to each other to form a fuel introduction port 28-1, and upstream sides of introduction passages 11*a*-2, 11*b*-2, 11*c*-2, and 11*d*-2 extend toward the center O1 of the nozzle plate 6 and each of them is connected to each other to form a fuel introduction port 28-2.

In the case of the present embodiment, points 40*a*-1, 40*b*-1, 40*c*-1, and 40*d*-1 constituting upstream side end portions of the introduction passages 11*a*-1, 11*b*-1, 11*c*-1, and 11*d*-1 are configured as follows. In the introduction passages 11*a*-1 and 11*d*-1, in both side walls of the introduction passages 11*a*-1 and 11*d*-1, intersection points between a perpendicular line from an upstream side end portion of the side wall which are far from a Y1 axis to the side wall which is close to the Y1 axis and central lines 14*a*-1 and 14*d*-1 are points 40*a*-1 and 40*d*-1. In the introduction passages 11*b*-1 and 11*c*-1, intersection points between a straight line connecting between the upstream side end portions of both side walls and central lines 14*b*-1 and 14*c*-1 are points 40*b*-1 and 40*c*-1.

Straight lines 30*a*-1, 30*b*-1, 30*c*-1 and 30*d*-1 passing through the intersection points 40*a*-1, 40*b*-1, 40*c*-1, and 40*d*-1 and a center O1 of the nozzle plate 6 are configured as shown in FIG. 10, and the introduction passages 11*a*-1, 11*b*-1, 11*c*-1, and 11*d*-1 are provided in a rotated (inclined) state similarly as described with reference to the introduction path 11*a*-1 of FIG. 4A with respect to the straight lines 30*a*-1, 30*b*-1, 30*c*-1, and 30*d*-1.

The fuel injection passages 10B1 to 10B4 are configured similar to the fuel injection passages 10A1 to 10A4, and disposed axis-symmetrically with the fuel injection passages 10A1 to 10A4 with respect to the Y1 axis.

According to this configuration, the fuel flowing in the fuel introduction port 28-1 tends to flow in the introduction passages 11*a*-1, 11*b*-1, 11*c*-1, and 11*d*-1 uniformly, whereas the fuel flowing in the fuel introduction port 28-2 tends to flow in the introduction passages 11*a*-2, 11*b*-2, 11*c*-2, and 11*d*-2 uniformly. Therefore, fuel injected from spray holes 13*a*-1, 13*b*-1, 13*c*-1, and 13*d*-1 becomes uniform, and fuel injected from spray holes 13*a*-2, 13*b*-2, 13*c*-2, and 13*d*-2 becomes uniform.

Further, since the introduction passages 11*a*-1, 11*b*-1, 11*c*-1, 11*d*-1, 11*a*-2, 11*b*-2, 11*c*-2, and 11*d*-2 each extend toward the center O1 of the nozzle plate 6, it is possible to lengthen a passage length of the introduction passages 11*a*-1, 11*b*-1, 11*c*-1, 11*d*-1, 11*a*-2, 11*b*-2, 11*c*-2, and 11*d*-2. As a result, the fuel inflowing from the fuel introduction ports 28-1 and 28-2 can obtain a sufficient runaway section until the fuel flows in the spray holes 13*a*-1, 13*b*-1, 13*c*-1, 13*d*-1, 13*a*-2, 13*b*-2, 13*c*-2, and 13*d*-2, respectively, is more easily rectified, and easily generates a flow F1 directly flowing in the spray hole and a flow along a side surface 56*a*-1 which induces a swirling flow F3. Thus, an effect of atomization and narrowing of an angle is improved.

Sixth Embodiment

Figure 11:
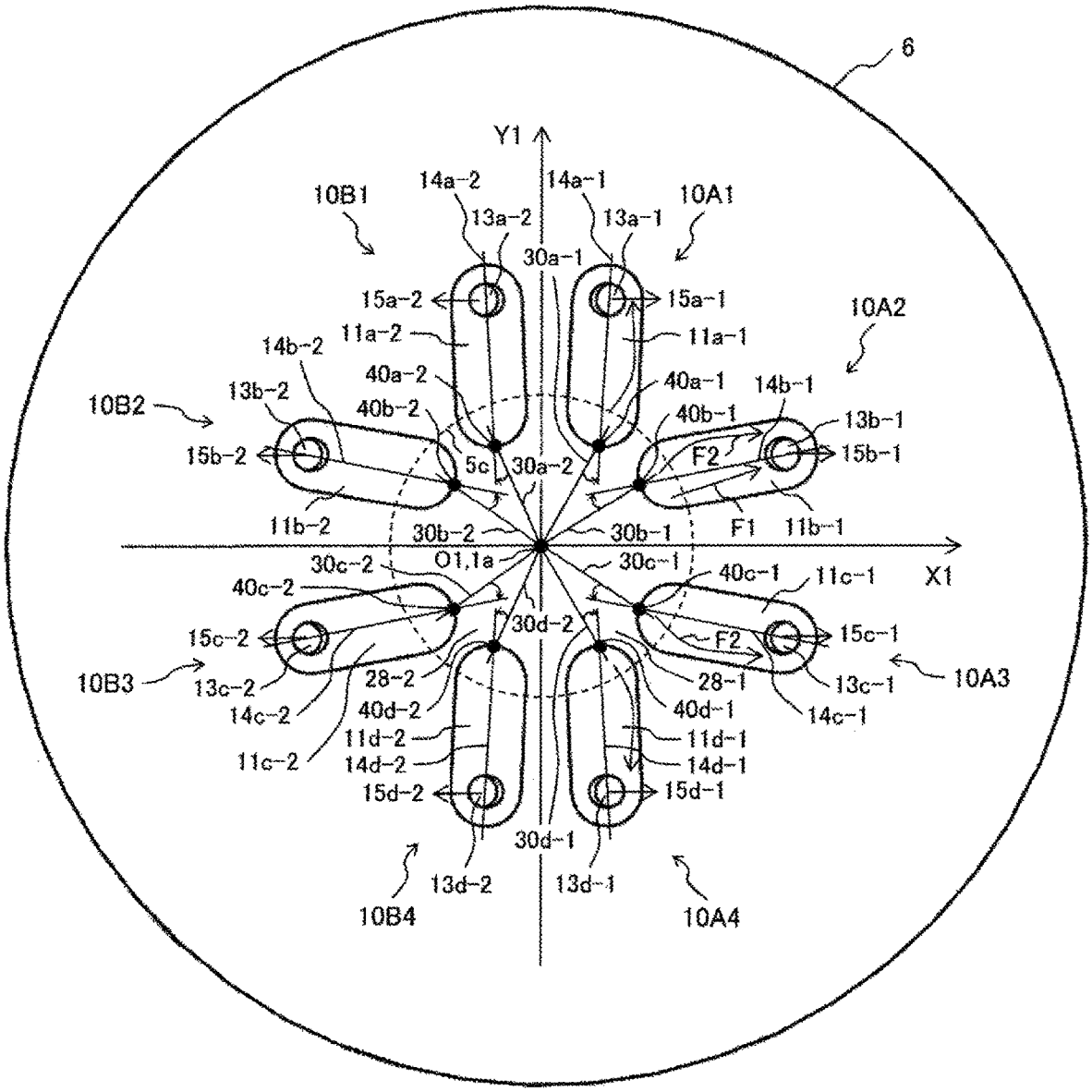
FIG. 11 is a diagram showing a nozzle plate 6 of a fuel injection valve 1 according to a sixth embodiment of the present invention when viewed from a valve body side (base end side).

Next, a sixth embodiment according to the present invention will be described with reference to FIG. 11. FIG. 11 is a diagram showing a nozzle plate 6 of a fuel injection valve 1 according to the sixth embodiment of the present invention when viewed from a valve body side (base end side).

A difference between the present embodiment and the first embodiment is that introduction passages 11*b*-1, 11*c*-1, 11*b*-2, and 11*c*-2 are disposed to be rotated by a predetermined angle on an opposite side to that of the first embodiment with respect to a straight line (for example, 30*b*-1) extending from a center O1 of the nozzle plate 6 outwardly in a radial direction. That is, in the first embodiment, like a fuel injection passage 10A1 shown in FIG. 11, an introduction passage 11*a*-1 is disposed so that a central line 14*a*-1 of an introduction passage is rotated counterclockwise by a predetermined angle based on a point 40*a*-1 with respect to a straight line 30*a*-1, whereas like the fuel injection passage 10A2 of FIG. 11, an introduction passage 11*b*-1 in the present embodiment is disposed so that a central line 14*b*-1 of the introduction passage is rotated clockwise by a predetermined angle based on a point 40*b*-1 with respect to the straight line 30*b*-1.

An introduction passage 11*c*-1 is disposed so that a central line 14*c*-1 of the introduction passage is rotated counterclockwise by a predetermined angle based on a point 40*c*-1 with respect to a straight line 30*c*-1, and an introduction passage 11*d*-1 is disposed so that a central line 14*d*-1 of the introduction passage is rotated clockwise by a predetermined angle based on a point 40*d*-1 with respect to a straight line 30*d*-1. An introduction passage 11*a*-2 is disposed so that a central line 14*a*-2 of the introduction passage is rotated clockwise by a predetermined angle based on a point 40*a*-2 with respect to a straight line 30*a*-2, and an introduction passage 11*b*-2 is disposed so that a central line 14*b*-2 of the introduction passage is rotated counterclockwise by a predetermined angle based on a point 40*b*-2 with respect to a straight line 30*b*-2. An introduction passage 11*c*-2 is disposed so that a central line 14*c*-2 of the introduction passage is rotated clockwise by a predetermined angle based on a point 40*c*-2 with respect to a straight line 30*c*-2, and an introduction passage 11*d*-2 is disposed so that a central line 14*d*-2 of the introduction passage is rotated counterclockwise by a predetermined angle based on a point 40*d*-2 with respect to a straight line 30*d*-2.

That is, in the present embodiment, the fuel injection valve has the following configuration. First, the nozzle plate 6 and a first direction and a second direction in which a fuel spray is directed are projected onto a virtual plane perpendicular to a central axis line 1*a*, and a first orthogonal coordinate system which has an X1 axis passing through the center O1 of the nozzle plate 6 and along the first direction and a Y1 axis passing through the center O1 of the nozzle plate 6 and perpendicular to the X1 axis is virtualized on the virtual plane. In the present embodiment, the virtual plane may be considered to be an upper end surface of the nozzle plate 6. The plurality of fuel injection passages 10A1 to 10A4 and 10B1 to 10B4 includes inclined fuel injection passages 10A1, 10A4, 10B1, and 10B4 in which a straight line segment 14 connecting between a central point 40 of an upstream side end portion of the introduction passage 11 and a center O of an inlet opening surface of the fuel injection hole 13 is positioned on the Y1 axis side with respect to a straight line 30 passing through the center point 40 and the center O1 of the nozzle plate 6. At least one of the inclined fuel injection passages 10A1, 10A4, 10B1, and 10B4 is disposed in four partitions (quadrants) divided by the X1 axis and the Y1 axis of the first rectangular coordinate system.

The straight line segment 14 connecting between the center point 40 of the upstream side end portion of the introduction passage 11 and the center O of the inlet opening surface of the fuel injection hole 13 means a portion between the central point 40 of the straight line 14 and the center O of the inlet opening surface.

According to this configuration, when the fuel flowing in the introduction passages 11*b*-1, 11*c*-1, 11*b*-2, and 11*c*-2 flows in the spray holes 13*b*-1, 13*c*-1, 13*b*-2, and 13*c*-2, since spray hole inclination directions 15*b*-1, 15*c*-1, 15*b*-2, and 15*c*-2 are directed in a direction substantially along a stream line of the flow F1 directly flowing in the spray hole, the collision force applied to the inner wall of the spray hole 13 becomes weak, the influence of the swirling flow F3 induced by the flow F2 becomes stronger, and the spray angle tends to widen. However, in the configuration according to the present embodiment, since the introduction passages 11*a*-1, 11*d*-1, 11*a*-2, and 11*d*-2 are rotated by a predetermined angle in the same direction as the first embodiment, the spray injected from the spray holes 13*a*-1, 13*d*-1, 13*a*-2, and 13*d*-2 is quickly atomized as described in the first embodiment and becomes a spray having a controlled spray angle. Therefore, when viewing the entire spray from a positive direction of the X1 axis, since a narrow spray having a controlled spray angle is injected from the spray holes 13*a*-1 and 13*d*-1 at both ends, a spray having a large spray angle injected from the spray holes 13*b*-1 and 13*c*-1 at a central side is sandwiched by a spray having a narrow spray angle injected from the spray holes 13*a*-1 and 13*d*-1 at both ends, such that the expansion of the spray can be suppressed and the increase of the spray angle can be suppressed as a whole.

In particular, the inclined fuel injection passages 10A1, 10A4, 10B1, and 10B4 are disposed in at least one of four partitions (quadrants) divided by the X1 axis and the Y1 axis of the first orthogonal coordinate system, such that it is possible to suppress the increase of the spray angle in the spray injected in the first direction and the spray injected in the second direction and it is possible to suppress the increase of the spray angle as a whole.

Seventh Embodiment

Figure 12:
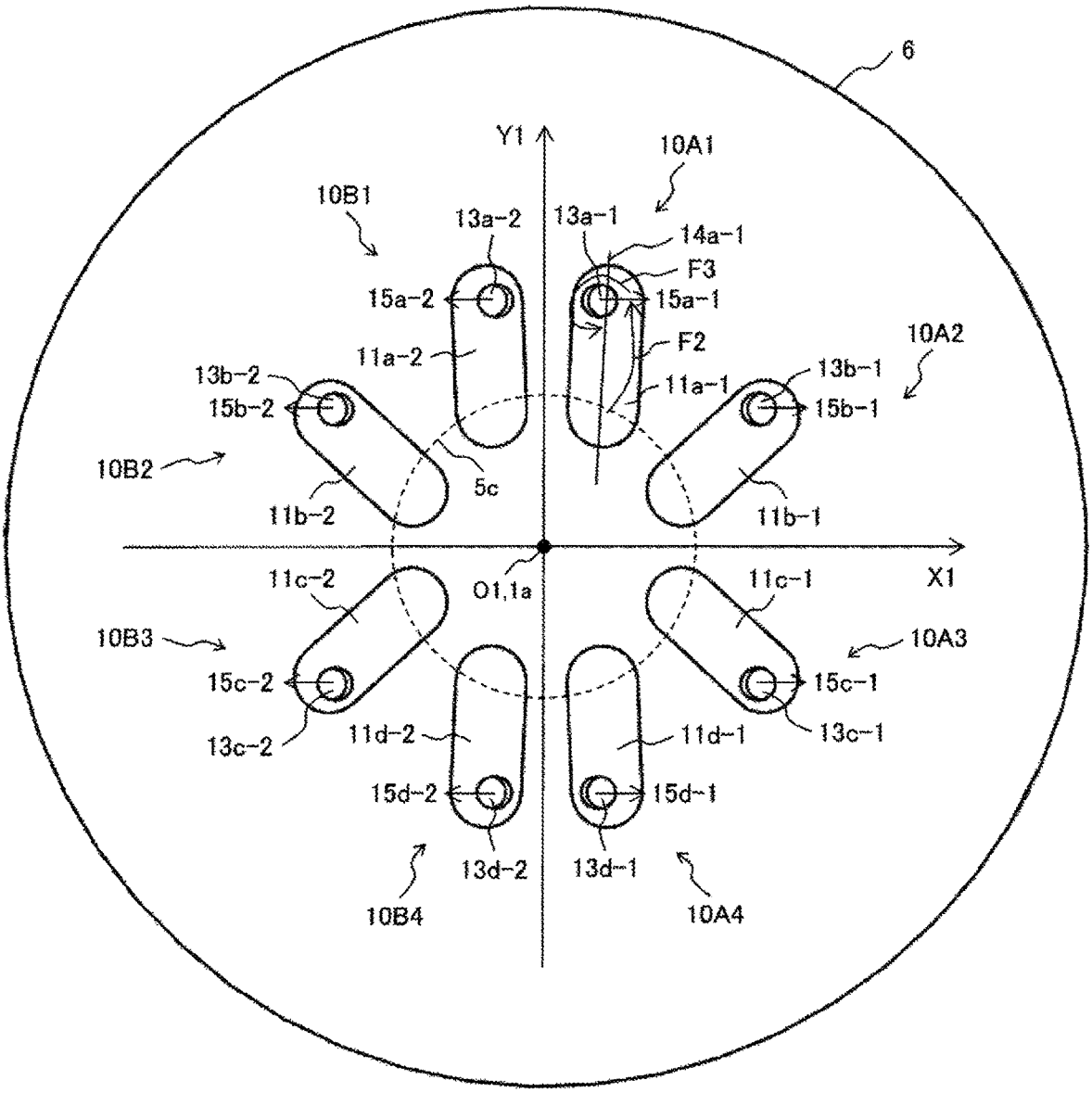
FIG. 12 is a diagram showing a nozzle plate 6 of a fuel injection valve 1 according to a seventh embodiment of the present invention when viewed from a valve body side (base end side).
Figure 13:
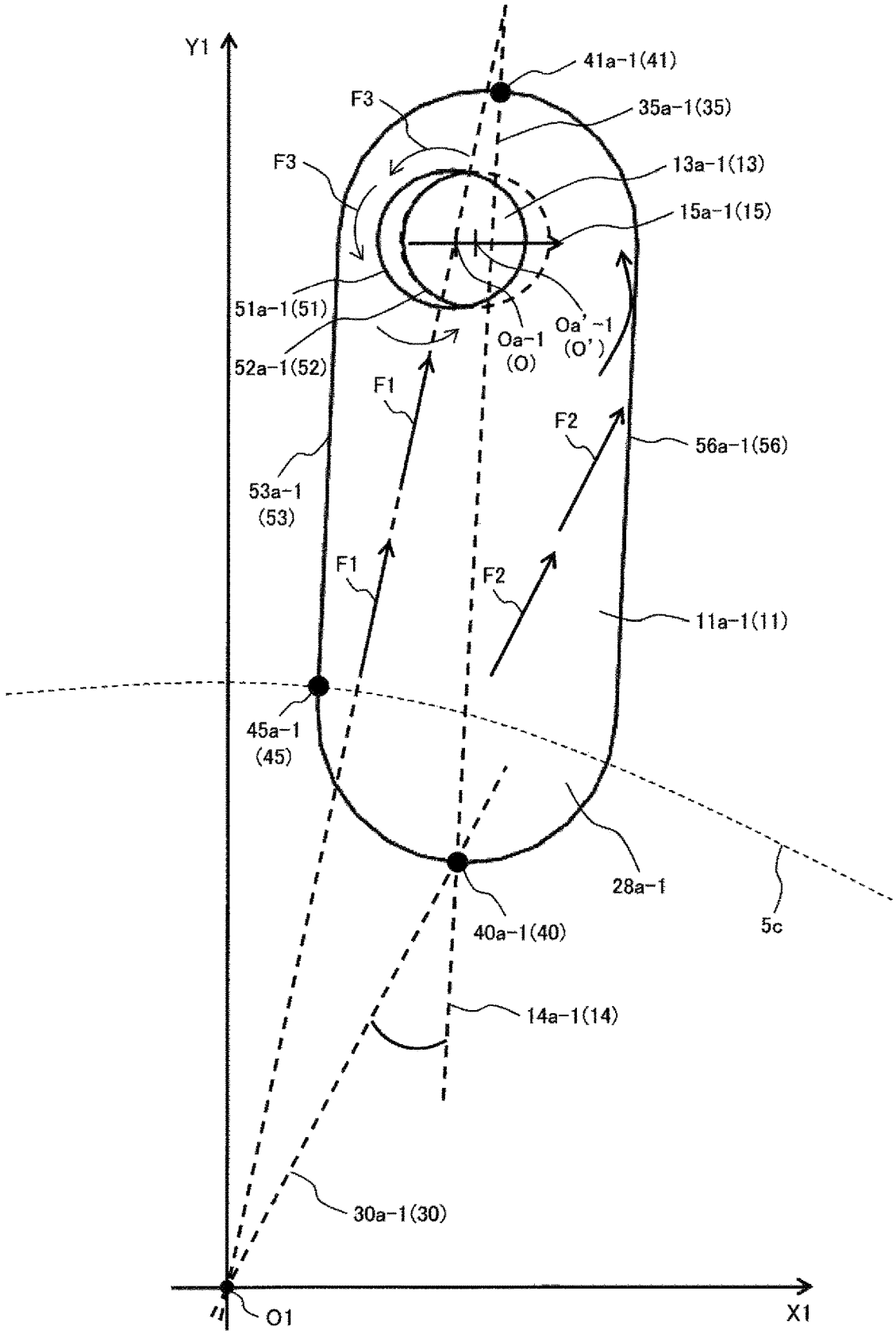
FIG. 13 is a view showing aspects of flows F1, F2, and F3 in a fuel injection passage 10A1 (10) according to the seventh embodiment of the present invention.

Next, a seventh embodiment according to the present invention will be described with reference to FIGS. 12 and 13. FIG. 12 is a diagram showing a nozzle plate 6 of a fuel injection valve 1 according to the seventh embodiment of the present invention when viewed from a valve body side (base end side). FIG. 13 is a view showing aspects of flows F1, F2, and F3 in the fuel injection passage 10A1 (10) according to the seventh embodiment of the present invention.

A difference between the present embodiment and the first embodiment is that in the first embodiment, a center of an inlet cross section of each spray hole 13 is disposed to be positioned on a central line 14 of an introduction passage 11, whereas in the present embodiment, a center of an inlet cross section of the spray hole 13 is disposed to be away from the central line 14 of the introduction passage 11 by a predetermined distance.

For example, in the fuel injection passage 10A1 in FIG. 12, a spray hole 13*a*-1 is disposed so that a center of an inlet cross section of the spray hole 13*a*-1 is positioned on a Y1 axis side with respect to a central line 14*a*-1 of an introduction passage 11*a*-1.

According to this configuration, there is an effect that the influence of a swirling flow F3 induced by a flow F2 along the wall surface 56*a*-1 of the introduction passage 11*a*-1 becomes stronger, and atomization can be further promoted.

Although FIGS. 3 to 12 show that spray hole inclination directions 15*a*-1, 15*b*-1, 15*c*-1, and 15*d*-1 are parallel to the X1 axis and are directed to a positive direction of the X1 axis, and spray hole inclination directions 15*a*-2, 15*b*-2, 15*c*-2, and 15*d*-2 are parallel to the X1 axis and directed to a negative direction of the X1 axis, it is needless to say that these spray hole inclination directions are each disposed to be directed to different directions within the angle range described in the first embodiment.

In addition, although FIGS. 3 to 12 show that each spray hole 13 is disposed on the same circle centered on the center O1 of the nozzle plate 6, each spray hole 13 is disposed on different circles. In addition, although the number of spray holes 13 has been described as eight in total, it is needless to say that the number of spray holes 13 may be various.

The present invention is not limited to the above-mentioned embodiment, but includes various modified examples. For example, the above-described embodiments have been described in detail in order to explain the present invention in an easy-to-understand manner, and are not necessarily limited to those having all the configurations described. Further, a part of the configuration of one embodiment can be replaced by the configuration of another embodiment, and the configuration of another embodiment can be added to the configuration of one embodiment. In addition, another embodiment can be added to, deleted from, or replaced with a part of a configuration of the embodiments.

REFERENCE SIGNS LIST

1 fuel injection valve
2 casing
2*a* fuel supply port
3 valve body
4 anchor
5 nozzle body
6 nozzle plate
00 fuel injection passage
11 introduction passage
13 spray hole
14 central line of introduction passage
15 inclination direction of spray hole
16 yoke
F1 flow of fuel directly flowing in spray hole
F2 flow along introduction passage side surface 56
F3 swirling flow
20 filter
21 O ring
22 resin cover
23 connector
24 protector
O ring
28 fuel introduction port
31, 32 spray
35 line connecting between center O1 of nozzle plate 6 and center Oa of inlet cross section of spray hole
51 inlet cross section of spray hole (inlet opening surface)
52 outlet cross section of spray hole (outlet opening surface)
53 side surface of introduction passage
56 side surface of introduction passage

The invention claimed is:

1. A fuel injection valve comprising: a valve seat; a valve body which cooperates with the valve seat to open and close a fuel passage by being displaced in an opening and closing valve direction; and a nozzle plate which is provided with a plurality of fuel injection passages constituted by a fuel injection hole and an introduction passage downstream side end portion of which is provided with the fuel injection hole, the plurality of fuel injection passages including a plurality of fuel injection passages through which fuel is sprayed toward a first direction and a plurality of fuel injection passages through which fuel is sprayed toward a second direction different from the first direction, wherein when the nozzle plate and the first direction are projected onto a virtual plane perpendicular to a central axis line of the fuel injection valve along the opening and closing valve direction of the valve body and a first orthogonal coordinate system having an X1 axis passing through a center of the nozzle plate and along the first direction and a Y1 axis passing through the center of the nozzle plate and perpendicular to the X1 axis is virtualized on the virtual plane, in the plurality of fuel injection passages, an inclined fuel injection passage is included so that a straight line segment connecting between a central point of an upstream side end portion of the introduction passage and a center of an inlet opening surface of the fuel injection hole is disposed inclined so as to be positioned on the Y1 axis side with respect to a straight line passing through the central point and the center of the nozzle plate, and the inclined fuel injection passage is disposed in at least one of four partitions divided by the X1 axis and the Y1 axis of the first orthogonal coordinate system.

2. The fuel injection valve according to claim 1, wherein the inlet opening surface of the fuel injection hole is disposed at a position at which the inlet opening surface overlaps with a central line along an upstream and downstream direction of the introduction passage on the virtual plane.

3. The fuel injection valve according to claim 1, wherein an angle θ' between the straight line passing through the central point and the center of the nozzle plate and a straight line segment connecting between the central point and the inlet opening surface of the fuel injection hole is $0° < \theta' < 90°$ on the virtual plane.

4. The fuel injection valve according to claim 1, wherein the fuel injection hole of the inclined fuel injection passage is inclined with respect to the central axis line of the fuel injection valve, and when, on the virtual plane, a second orthogonal coordinate system which has an X2 axis passing through the center of the inlet opening surface of the fuel injection hole and parallel to the X1 axis and a Y2 axis passing through the center of the inlet opening surface of the fuel injection hole and perpendicular to the X2 axis and in which a direction away from an original point of the first orthogonal coordinate system on the Y2 axis is set to be 0° and an angular direction rotating from an angular position of 0° toward a side on which an absolute value of X1 is increased in a quadrant in which a spray hole exists is set to be a positive angular direction is virtualized, an inclination angle θ of a central line from the inlet opening surface of the fuel injection hole toward an outlet opening surface in the inclined fuel injection passage is $0° < \theta < 180°$ on the second orthogonal coordinate system.

5. The fuel injection valve according to claim 1, wherein in the plurality of fuel injection passages, introduction passages of at least part of the fuel injection passages are connected at the upstream side end portion.

6. The fuel injection valve according to claim 1, wherein in all the fuel injection passages, the straight line segment connecting between a central point of the upstream side end portion of the introduction passage and the center of the inlet opening surface of the fuel injection hole is inclined to be positioned on the Y1 axis side with respect to the straight line passing through the central point and the center of the nozzle plate.

* * * * *